US008388179B2

(12) United States Patent
Hood et al.

(10) Patent No.: US 8,388,179 B2
(45) Date of Patent: Mar. 5, 2013

(54) LIGHTING SYSTEMS

(75) Inventors: Alasdair Stuart Hood, Auckland (NZ); Neil Steven Poulton, Auckland (NZ)

(73) Assignee: Lantern Holdings Limited, Auckland (NZ)

( * ) Notice: Subject to any disclaimer, the term of this patent is extended or adjusted under 35 U.S.C. 154(b) by 562 days.

(21) Appl. No.: 12/602,368

(22) PCT Filed: May 31, 2007

(86) PCT No.: PCT/NZ2007/000135

§ 371 (c)(1),
(2), (4) Date: Jun. 21, 2010

(87) PCT Pub. No.: WO2007/139405

PCT Pub. Date: Dec. 6, 2007

(65) Prior Publication Data

US 2010/0265716 A1 Oct. 21, 2010

(30) Foreign Application Priority Data

Jun. 1, 2006 (NZ) ..... 547635

(51) Int. Cl.

| | |
|---|---|
| ***F21V 1/00*** | (2006.01) |
| ***F21V 11/00*** | (2006.01) |
| ***F21V 9/00*** | (2006.01) |
| ***F21V 17/02*** | (2006.01) |

(52) U.S. Cl. ..... 362/238; 362/321

(58) Field of Classification Search ..... 362/238, 362/269, 321

See application file for complete search history.

(56) References Cited

U.S. PATENT DOCUMENTS

| | | | | | |
|---|---|---|---|---|---|
| 3,769,503 | A | * | 10/1973 | Kim | 362/280 |
| 3,990,787 | A | * | 11/1976 | Modert | 359/233 |
| 4,074,124 | A | * | 2/1978 | Maute et al. | 362/217.02 |
| 4,338,655 | A | * | 7/1982 | Gulliksen et al. | 362/281 |
| 5,233,198 | A | * | 8/1993 | Changaris | 250/504 R |
| 6,422,717 | B1 | | 7/2002 | Beadle | |

FOREIGN PATENT DOCUMENTS

| | | | |
|---|---|---|---|
| EP | 1 457 735 | A1 | 9/2004 |
| JP | 03-184205 | A | 8/1991 |
| WO | 95/34782 | A1 | 12/1995 |
| WO | 03/023513 | A1 | 3/2003 |

* cited by examiner

*Primary Examiner* — David J Makiya
(74) *Attorney, Agent, or Firm* — Sughrue Mion, PLLC

(57) ABSTRACT

The invention disclosed relates to a light housing adapted to retain a light source. The light housing has a first reflector and a second reflector mounted to rotate concentrically about a main axis. A transmission system is present between the first and second reflector. Rotation of the first reflector in a first direction about the main axis rotates the second reflectors via the transmission system at the same angular velocity as the first reflector about the main axis to retain the same relative angular position between the first and second reflectors. Rotation of the first reflector in a second direction of rotation, opposite to the first direction, rotates the second reflector, via the transmission system to vary the relative angular position between the first and second reflector.

21 Claims, 36 Drawing Sheets

Figure 1B:
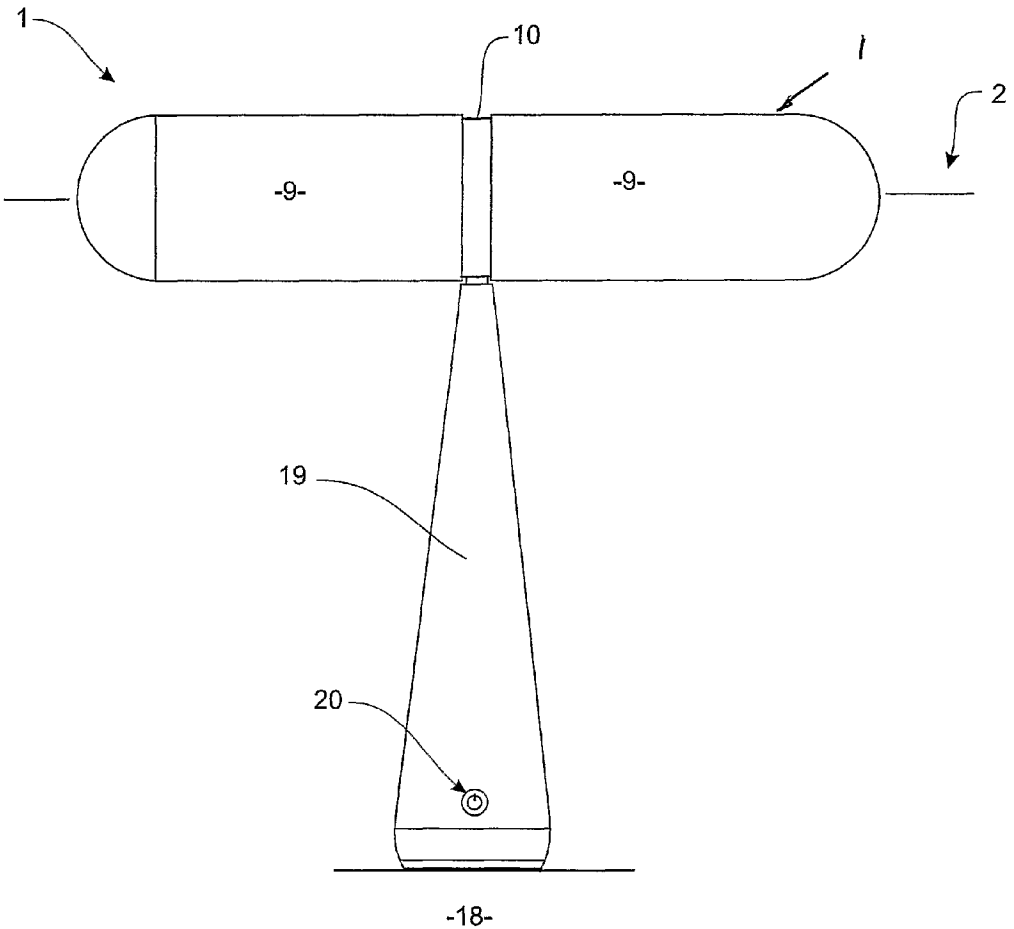

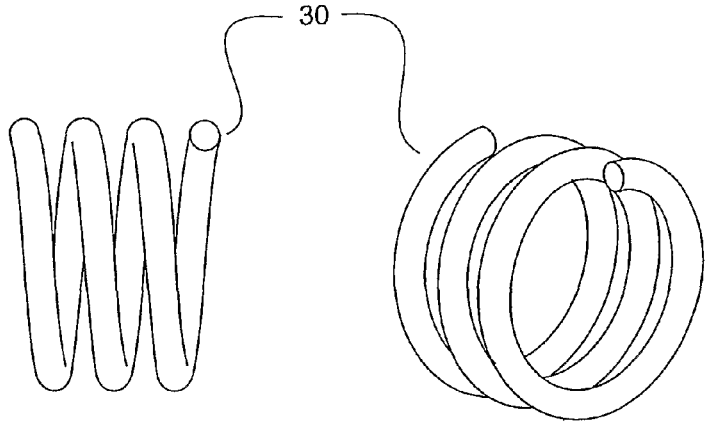
Fig 15 (A)
Fig 15 (B)
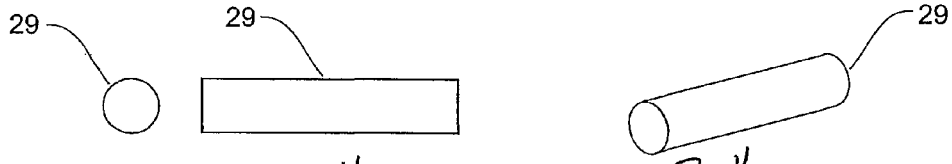
Fig 16 (A)
Fig 16 (B)
Fig 16 (C)
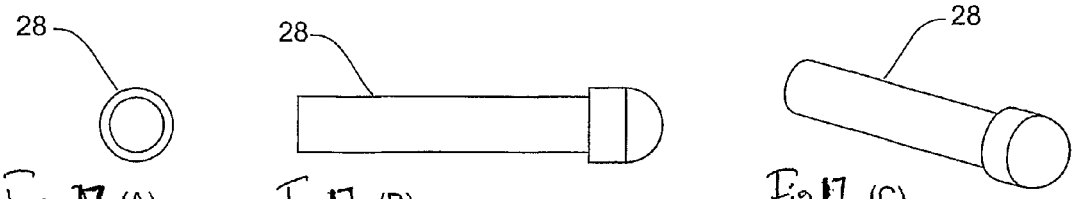
Fig 17 (A)
Fig 17 (B)
Fig 17 (C)

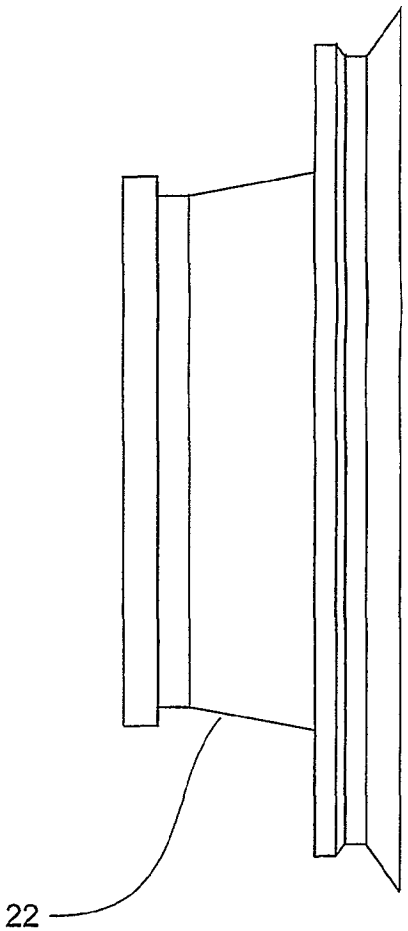
Fig 3° (B)
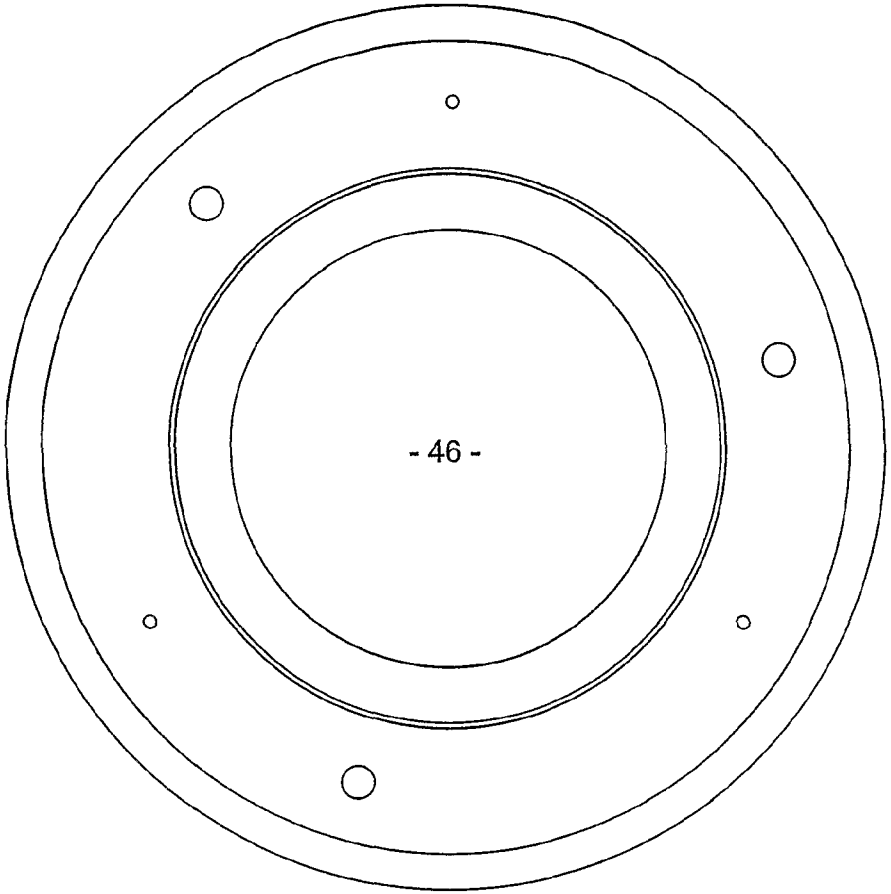
Fig 3° (A)

LIGHTING SYSTEMS

CROSS REFERENCE TO RELATED APPLICATION

This application is a National Stage of International Application No. PCT/NZ2007/000135 filed May 31, 2007, the contents of which are incorporated herein by reference in their entirety.

The present invention relates to lighting fixtures and in particular although not solely to lighting fixtures that offer both adjustment of the direction the light beam is cast, and the angular width of the light aperture to adjust the width or intensity of the light beam cast.

There is known in the art various ways for location and orienting of a light beam source. The most simple of these is referred to commonly as an angle poise lamp. It has a light source mounted via a parallelogram connector to a base for example. Such a light is variable in its cast direction, by changing the angle of the mechanism holding the light source.

Lighting fixtures may also use a light source that is electronically dimmable to control the light beam intensity.

Dimming may also occur by virtue of a cover member to cover and uncover a light source mounted in a light shade. It can not provide independence of both light intensity and angle of cast light. A secondary cover can be used, in conjunction with the first, to adjust the angle of the light and intensity. Such a fixture requires a two handed or double handling approach which is not efficient.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or faun part of the common general knowledge in the art. It is therefore an object of the present invention to provide an improved lighting fixture that at least goes some way to overcoming the above problems or at least provides the public with a useful choice.

It is therefore an object of the present invention to provide an improved lighting fixture that at least goes some way to overcoming the above problems or at least provides the public with a useful choice.

In a first aspect the present invention may be said to broadly consist in a lamp comprising, a bearing member, a first reflector and a second reflector mounted for rotation dependent from said bearing member in a concentric relationship but at non-coincident radii to each other about an axis, said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, said opening of said first reflector positionable to be, at least in part, contiguous said opening of said second reflector to thereby define an aperture for light from said light source to project radially out from said lamp, a rotation limiter operative between said first reflector and said second reflector that (a) in said first direction of rotation of said first reflector prevents relative rotation between said first reflector and said second reflector to allow said first and second reflectors to be rotated at a same rotational velocity about said axis to thereby change the rotational orientation of said aperture, and (b) in said second direction of rotation of said first reflector does not prevent relative rotation between said first reflector and second reflector to allow said first and said second reflector to move relative each other at different rotational velocities about said axis to thereby change said aperture size.

Preferably said rotation limiter is a ratchet that includes a series of ratchet teeth carried by one of said first and second reflectors and presented coaxially said axis, and at least one ratchet pawl carried by the other of said first and second reflectors, said pawl engaged with said series of teeth to move thereover in said second direction of rotation of said first reflector, and to lock with said series teeth in said first direction of movement of said second reflector.

Preferably said second reflector is journalled to said bearing member in a manner so that a resistance to relative rotation between said bearing member and said second reflector is established.

Preferably said resistance is as a result of friction.

Preferably said resistance is sufficient to overcome the result of any resistance to rotation between said first and second reflectors resultant from said rotation limiter when said first reflector is rotated in said second direction, thereby allowing said relative rotation between said first and second reflectors and wherein said second reflector remains stationary relative to said bearing member.

In a further aspect the present invention consists in a lamp comprising or including, a first aperture defining member able to be driven to rotate about a rotational axis, an input cog able to be driven about a second rotational axis parallel to said first mentioned rotational axis, an output cog (preferably mounted co-axially to said input cog) in one way drivable engagement (whether directly or indirectly) with said input cog, a first ring member able to be driven by said output cog to rotate a second aperture defining member about said first mentioned rotational axis, said first and second aperture defining members able to define at least one aperture to an at least partial enclosure that can be defined between said first and second aperture defining members and within which a light source can be placed, wherein driving said input cog in a first direction about said second rotational axis rotates said first and second aperture defining members relative each other to alter the size of said at least one aperture there between, and driving said input cog in a second (opposite) direction about said second rotational axis rotates said first and second aperture defining members about said axis to alter the angular location of said at least one aperture about said axis (preferably without changing the size of said at least one aperture there between).

Preferably said first aperture defining member is mounted to move along an arc of radius concentric to, and outward from, an arc along which said second aperture defining member is mounted to move.

Preferably said first aperture defining member is mounted to move along an arc of radius concentric to, and inward from, an arc along which said second aperture defining member is mounted to move.

Preferably said first aperture defining member is able to be rotationally driven by a second ring member that is rotationally mounted about said first mentioned rotational axis.

Preferably said second ring member in affixed to said first aperture defining member.

Preferably said second ring member is driven, directly or indirectly by said input cog.

Preferably a rotational actuator, in driving engagement with said input cog, can rotate said input cog to actuate the rotation of said second ring member.

Preferably said rotational actuator is an actuator ring independently mounted from said first aperture defining member.

Preferably said second ring member is in driving engagement with said input cog to rotationally drive said input cog.

Preferably a rotational actuator, affixed to said second ring member and said first aperture defining member is provided to actuate the rotational movement of said second ring member and hence said first aperture defining member.

Preferably said rotational actuator is a shell about said first and second aperture defining members.

Preferably said output cog is directly driven by and by engagement with an interior or exterior of said first ring member.

Preferably an output cog is rotationally drivable in a one way rotational direction but not the opposite by said input cog, via a ratchet toothed engagement with said input cog.

Preferably said input cog is directly or indirectly driven by toothed engagement with said second ring member.

Preferably a driving cog, mounted for rotation about an axis parallel to said rotational axis, is located to operate intermediate of said input cog and said second ring member to transmit rotational torque of said second ring member to said input cog.

Preferably said input cog, (a) when rotated in one rotational direction wherein it is in said one way drivable engagement by said output cog, drives said output cog to rotate said second aperture defining member at a different rotational velocity than said first aperture defining member to vary the relative positions of said apertures of said first and second aperture defining members to thereby change the effective aperture size for light cast from said light source, and (b) when rotated in an opposite direction to said one rotational direction wherein it is not in said one way drivable engagement by said output cog, leaves said output cog idle to not rotate said second aperture defining member.

Preferably said first and second aperture defining members are engaged to each other and wherein when said input cog is rotated in said opposite direction, said engagement between said first and second aperture defining members is coupled to rotate the first and second aperture defining members at the same rotational velocity to thereby vary the rotational position of the apertures of the first and second aperture defining members about said rotational axis to thereby change the direction for light to be cast from said light source without changing the effective aperture size.

Preferably said engagement between said first and second aperture defining members is a frictional engagement to allow coupled and decoupled rotation.

Preferably said frictional engagement is sufficient to overcome any resistance to coupled movement of said first and second aperture defining members by said one way drivable engagement between said input and output cogs when said input cog is being driven in the opposite direction.

Preferably said frictional engagement is established between, whether directly or indirectly, said first and second ring members.

Preferably said first and second aperture defining members are contained within a shell.

Preferably said shell is rotatable about said rotational axis and is able to drive, whether directly or indirectly, said input cog.

Preferably said first and second aperture defining members are contained within a shell and wherein said shell drives said second ring member to drive said input cog.

Preferably said first ring member is outwardly located and concentric to said second ring member.

Preferably a bearing member is provided to rotationally mount said first and second aperture defining members an said first ring member and first and second cogs.

Preferably said source of light is a fluorescent tube.

Preferably said coupled rotation is synchronous.

Preferably said at least one second reflector covers an arc between 1° and 270° about said axis.

Preferably said at least one first reflector cover an arc between 5° and 190° about said axis.

Preferably each of said reflectors can rotate through 360° about said main axis.

Preferably said shell is concentric to said main axis and outside of said reflectors that rotates with said at least one first reflector.

Preferably said shell is used to effect said rotation of said first reflector in both said first and opposite directions about said main axis.

Preferably said lighting fixture is mounted via at least one mounting point.

Preferably said mounting point is at one end of said lighting fixture.

Preferably there are two mounting points, one at each end of said lighting fixture.

Alternatively said lighting fixture extends either side of a central mounting point.

Preferably said light source is chosen from any one of i) a fluorescent tube, ii) an incandescent light, or iii) a light emitting diode.

Preferably said co- and counter-rotation of said at least one first and second reflectors is respectively achieved via friction and a one way system.

Alternatively said co- and counter-rotation of said at least one first and second reflectors is achieved via a one way gearing system and one way system.

Alternatively said co- or counter-rotation is achieved by a gearing system.

Preferably said one way system is a clutch.

Alternatively said one way system is a gearing system.

Preferably said light housing or lamp includes a mounting adapted to affix to a surface, for example a wall, floor or ceiling, a base adapted to affix to a surface, for example a wall, floor or ceiling.

Preferably said at least one first and second reflectors cover an arc each separately of 160°.

Preferably said light source is a fluorescent tube.

In a further aspect the present invention consists in a light housing adapted to retain a light source, comprising, mounted for rotation concentrically about a main axis is a first reflector, and a second reflector, wherein rotation of said first reflector in a first direction about said main axis rotates said second first reflector at the same angular velocity about the main axis to retain the same relative angular position between the first and second reflector, and rotation of said first reflector in a second direction of rotation, opposite to the first direction, rotates second reflector to vary the relative angular position between the first and second reflector.

Preferably said first reflector is rotatable by a rotation actuator that can be controlled for rotation by a person.

Preferably said rotation actuator is ring rotationally mounted to rotate about said main axis.

Preferably said rotation actuator is a shell about both said first and second reflectors that is rotationally mounted to rotate about said main axis.

Preferably said first reflector is journalled to said second reflector.

Preferably the journalled relationship between said first and second reflector has a sufficient frictional interface to cause the rotation of said second reflector with said first reflector when it is rotated in the first direction about the main axis.

Preferably upon rotation of said first reflector in a second direction of rotation, opposite to the first direction, rotation of second reflector at a different rotational velocity about said main axis is effected.

Preferably the rotation of said second reflector is effected by a transmission that is operatively interposed between the first and second reflectors, said transmission including an automatic clutch mechanism that engages the transmission for transfer of torque from said first reflector to said second reflector in the second direction of rotation and disengages the transmission in the first direction of rotation.

In yet a further aspect the present invention consists in a lamp comprising, a bearing member, a first reflector and a second reflector mounted for rotation dependent from said bearing member in a concentric relationship but at non-coincident radii to each other about an axis; said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, said opening of said first reflector positionable to be, at least in part, contiguous said opening of said second reflector to thereby define an aperture for light from said light source to project radially out from said lamp, a rotation transmission that can assume, i) an operative condition to, upon said rotation of said first reflector in said second direction of rotation, rotate said first and second reflectors relative each other at different rotational velocities about said axis to thereby change said aperture size, and ii) an inoperative condition to, upon said rotation of said first reflector in said first direction of rotation, allow rotation of said first reflector and said second at the same rotational velocity about said axis to thereby change the rotational orientation of said aperture about said axis.

In yet a further aspect still the present invention consists in a lamp comprising, a bearing member, a first reflector and a second reflector mounted for rotation dependent from said bearing member in a concentric relationship but at non-coincident radii to each other about an axis, said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, said opening of said first reflector positionable to be, at least in part, contiguous said opening of said second reflector to thereby define an aperture for light from said light source to project radially out from said lamp, a rotation transmission that can assume, i) an inoperative condition to, upon the rotation of said first reflector in the second direction of rotation, allow rotation of said first and second reflectors relative each other at different rotational velocities about said axis to thereby change said aperture size, and ii) an operative condition to, upon the rotation of said first reflector in said first direction of rotation, rotate said first reflector and said second at the same rotational velocity about said axis to thereby change the rotational orientation of said aperture about said axis.

In yet a further aspect still the present invention consists in a lamp comprising, a bearing member, a first reflector and a second reflector mounted for rotation dependent from said bearing member in a concentric relationship but at non-coincident radii to each other about an axis, said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, said opening of said first reflector positionable to be, at least in part, contiguous said opening of said second reflector to thereby define an aperture for light from said light source to project radially out from said lamp, a rotation transmission that can assume, i) a first operative condition to, upon the rotation of said first reflector in said second direction of rotation, allow rotation of said first and second reflectors relative to each other at different rotational velocities, about said axis to thereby change said aperture size, and ii) a second operative condition to, upon the rotation of said first reflector in said first direction of rotation, rotate said first reflector and said second at the same rotational velocity about said axis to thereby change the rotational orientation of said aperture about said axis.

In a further aspect the present invention consists in a fluid flow control apparatus comprising, a bearing member, a first fluid deflector and a second fluid deflector mounted for rotation dependent from said bearing member in a concentric relationship but at non-coincident radii to each other about an axis, said first fluid deflector rotatable, by actuation, in a first direction of rotation and a second direction of rotation opposite to said first direction of rotation about said axis, a fluid source to supply a fluid inward of said radii, to allow said first and second fluid deflectors to rotate at least in part about said fluid source, said first fluid deflector and second fluid deflector each including an opening to allow radially projecting fluid from said fluid source to pass through, said opening of said first fluid deflector positionable to be, at least in part, contiguous said opening of said second fluid deflector to thereby define an aperture for fluid from said fluid source to project radially out from said control apparatus, a rotation transmission that can assume i) a first operative condition to, upon the rotation of said first fluid deflector in said second direction of rotation, allow rotation of said first and second fluid deflectors relative to each other at different rotational velocities, about said axis to thereby change said aperture size, and ii) a second operative condition to, upon the rotation of said first fluid deflector in said first direction of rotation, rotate said first fluid deflector and said second at the same rotational velocity about said axis to thereby change the rotational orientation of said aperture about said axis.

In yet a further aspect still the present invention consists in a light housing as herein described and as shown with reference to any one or more accompanying drawings.

In yet a further aspect still the present invention consists in a lamp as herein described and as shown with reference to any one or more of the accompanying drawings.

In a further aspect of the present invention may be said to broadly consist in a lamp shade comprising or including a first and second reflector each independently rotatable about an axis and adapted to house a light source, wherein rotation of said first reflector in a first direction about said axis rotates said first and second reflectors together, and rotation of said first reflector in the opposite direction counter-rotates said first and second reflectors to each other.

As used herein the term "and/or" means "and" or "or", or both.

As used herein "(s)" following a noun means the plural and/or singular forms of the noun.

The term "reflector" as used in this specification means a member (whether unitary or otherwise) having a flat or preferably concave surface that shrouds the light source and substantially prevents transmission of the light. Preferably the reflector redirects at least some light emitted from the light source.

As used herein the term "clutch" should also be taken to include a mechanism that allows rotation one way but not the other.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

Figure 1A:
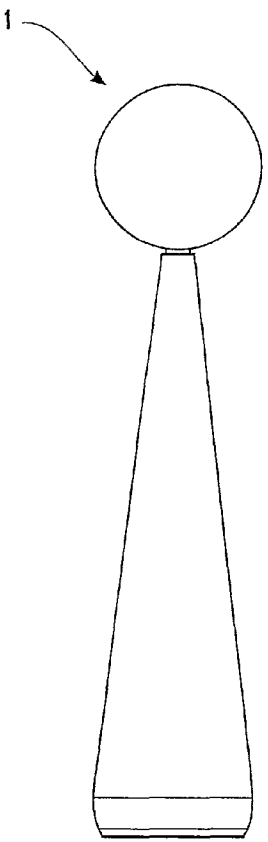
Figure 1C:
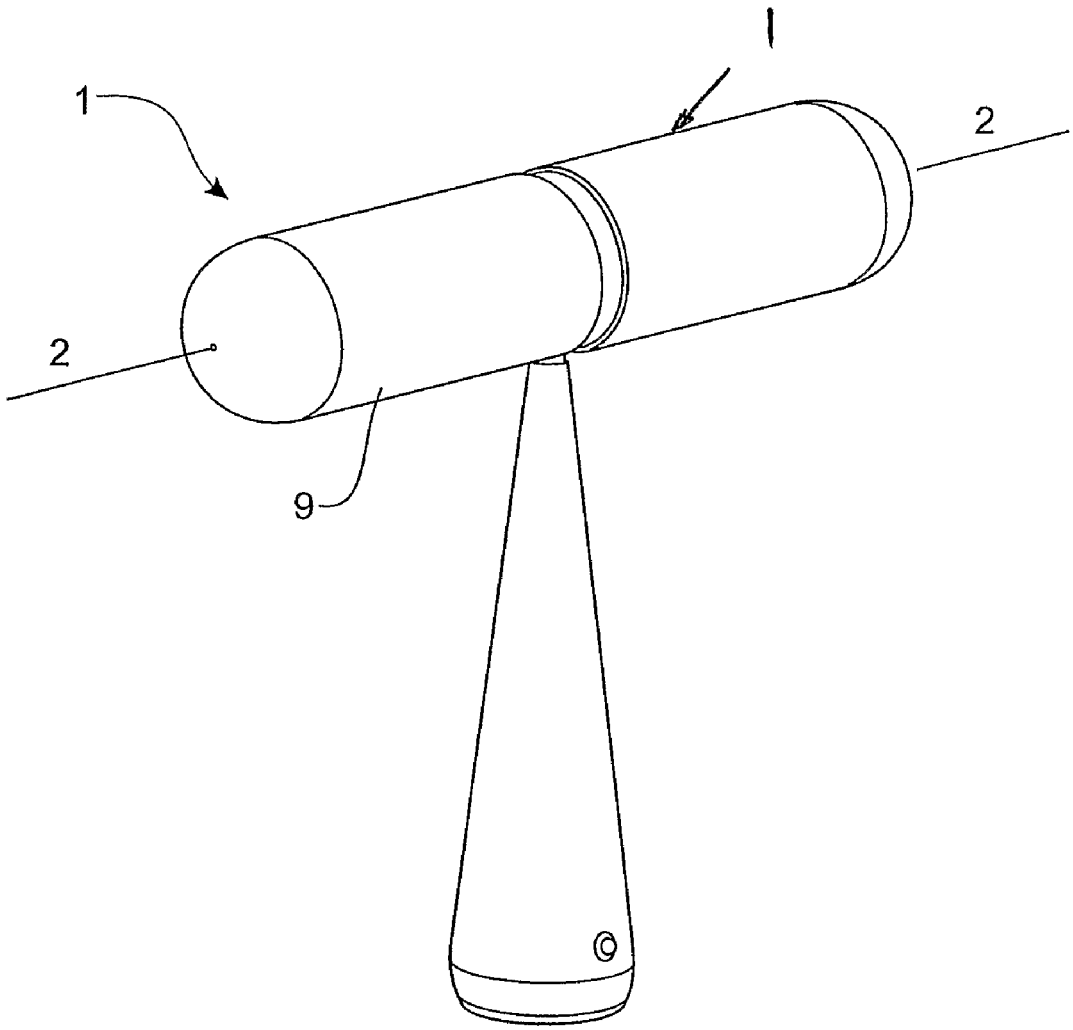
Figure 2B:
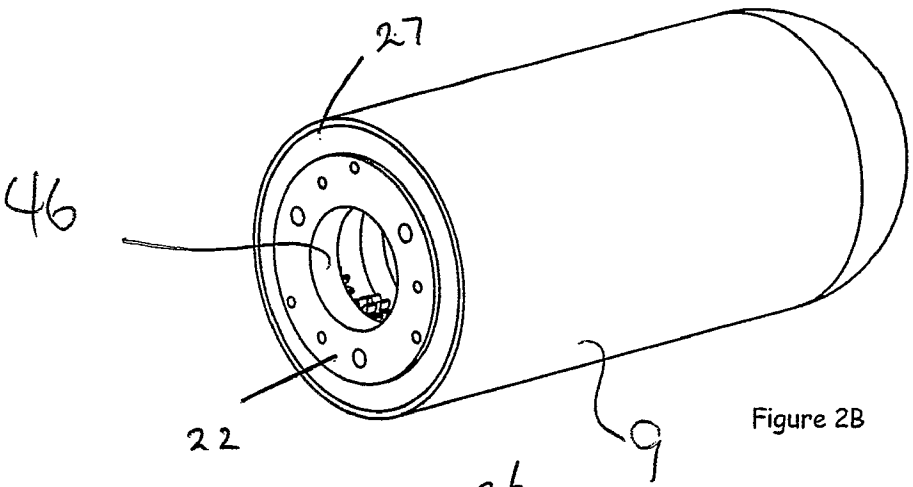
Figure 2C:
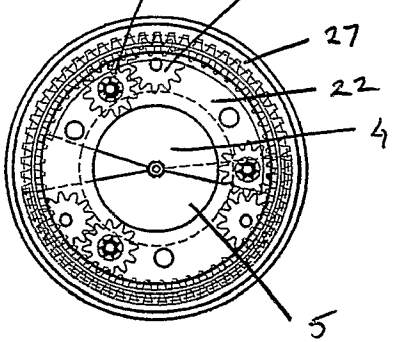
Figure 2A:
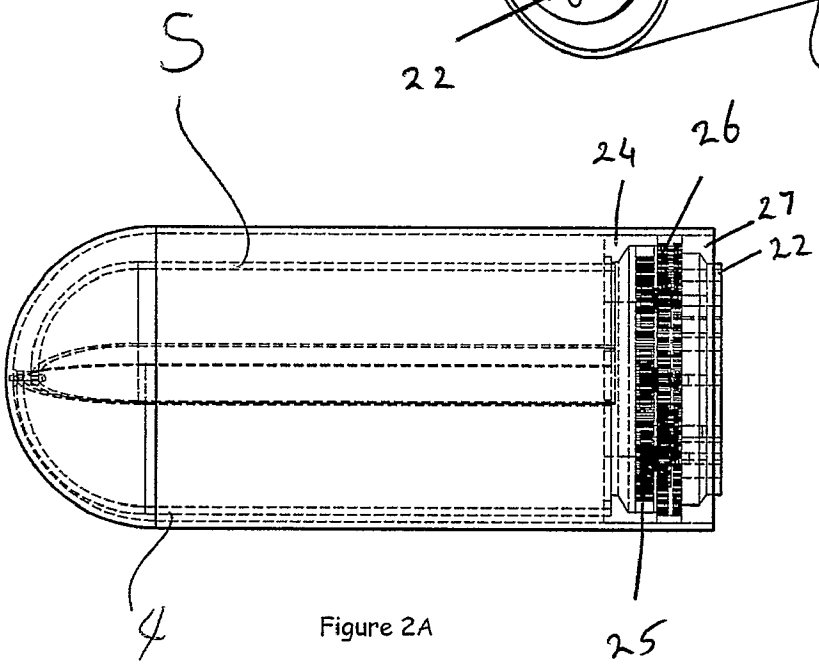
Figure 3A:
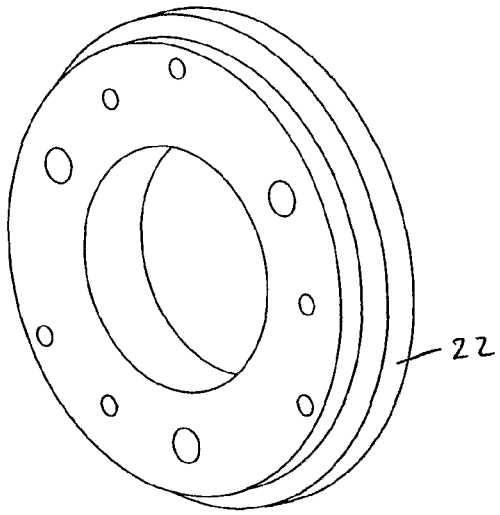
Figure 3B:
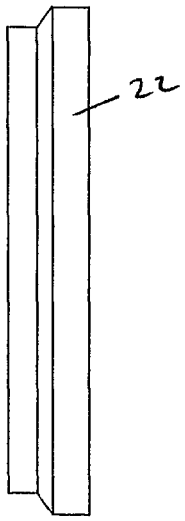
Figure 3C:
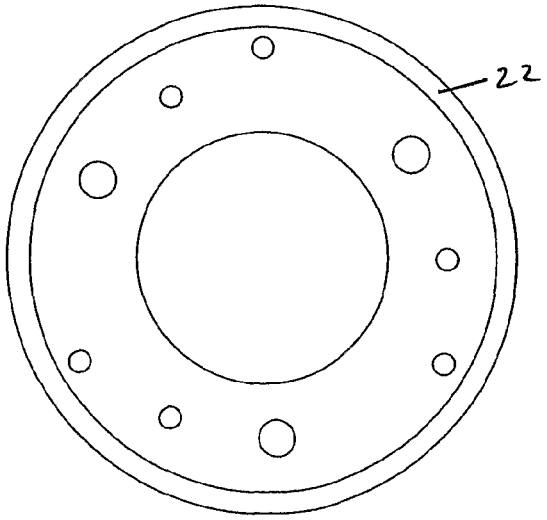
Figure 4A:
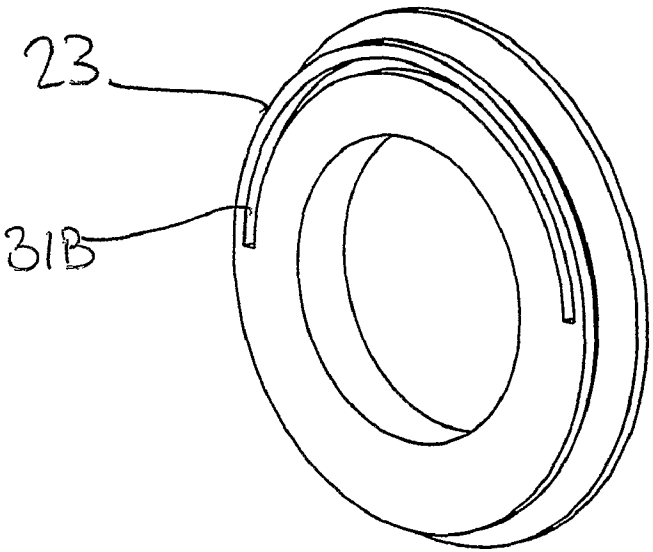
Figure 4C:
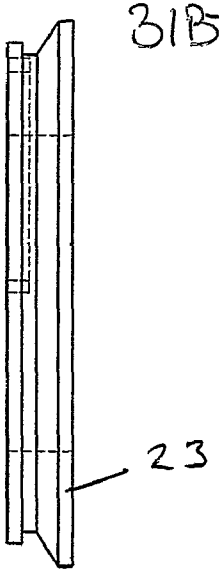
Figure 4B:
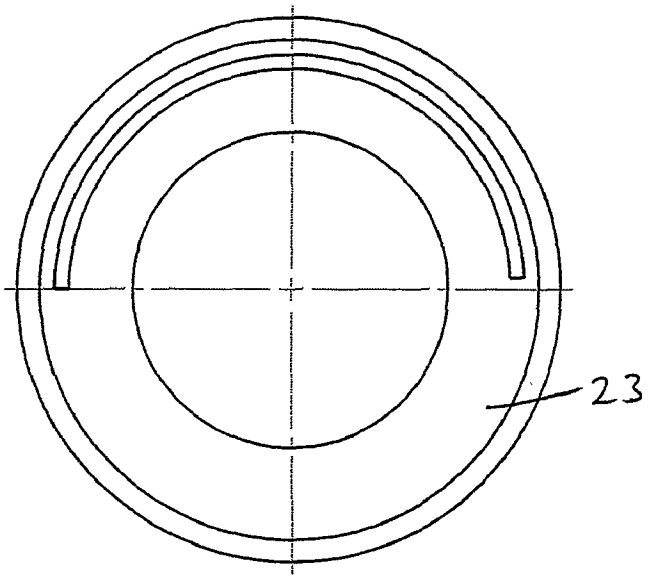
Figure 5A:
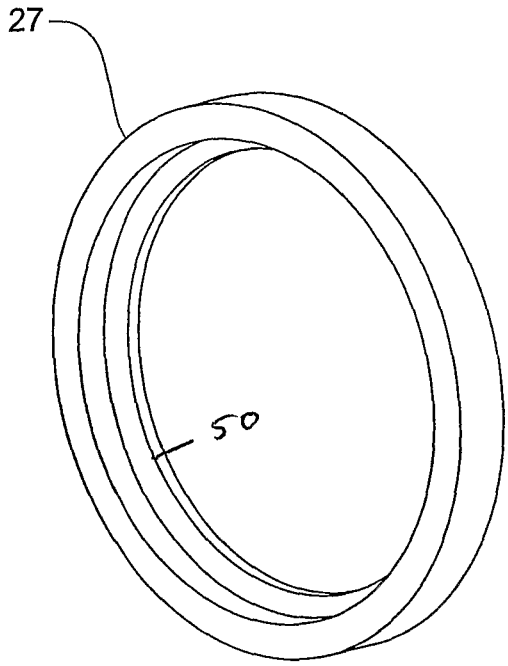
Figure 5B:
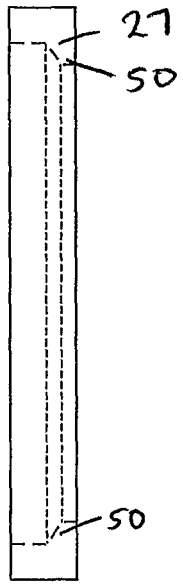
Figure 6A:
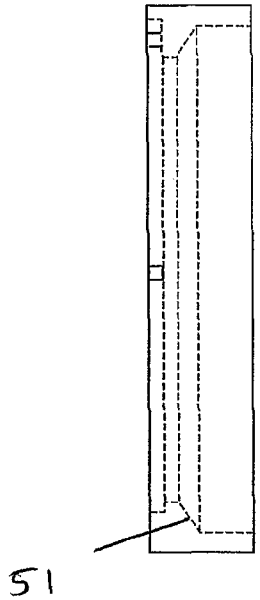
Figure 6B:
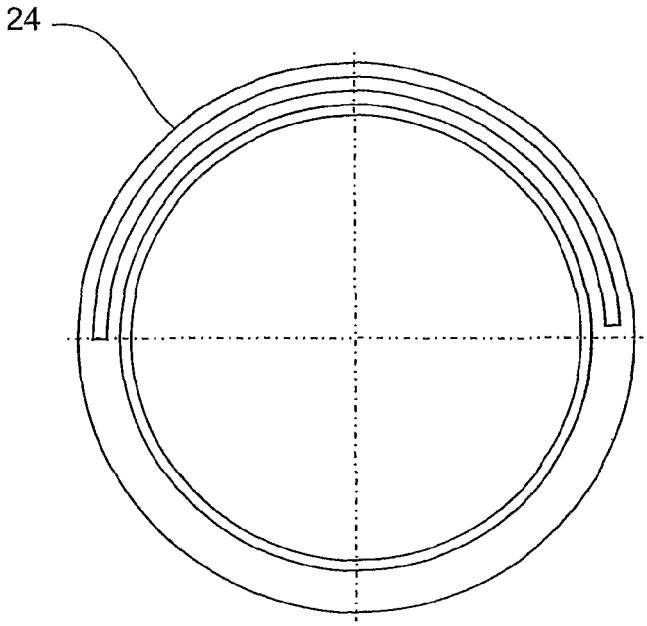
Figure 6C:
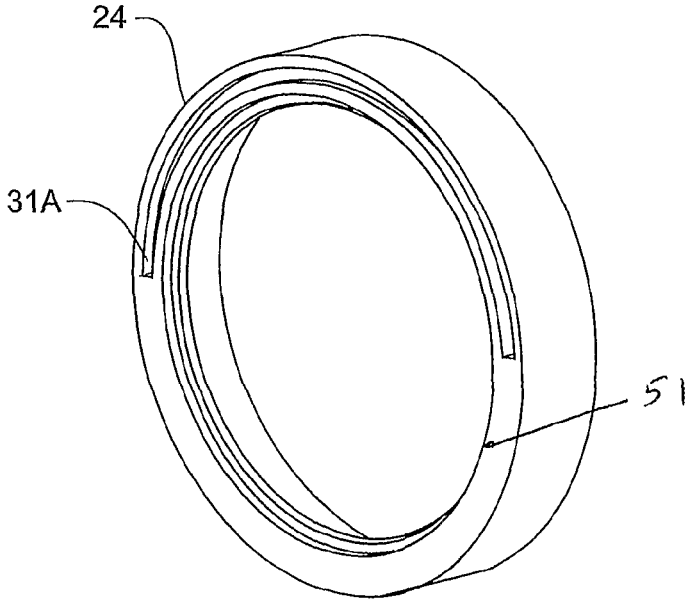
Figure 7A:
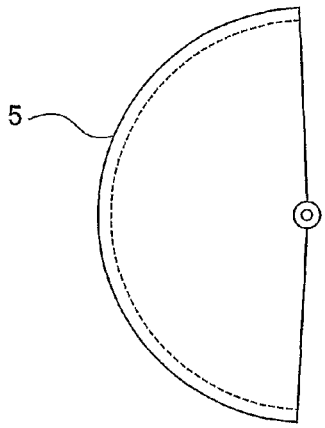
Figure 7B:
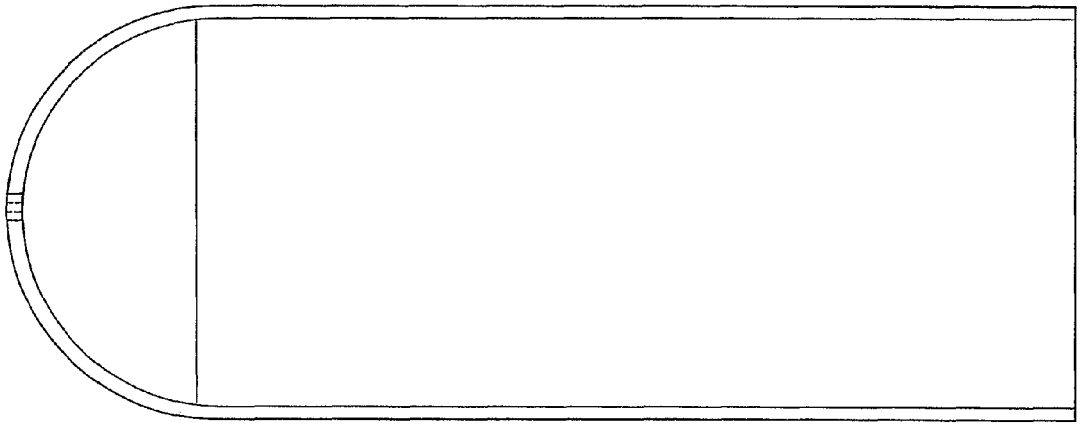
Figure 7C:
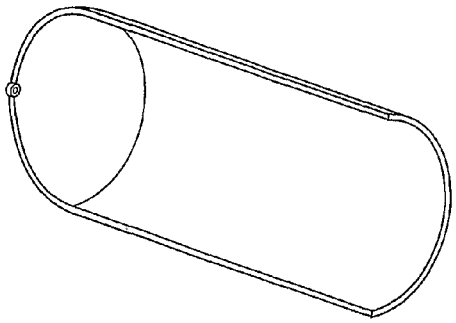
Figure 8A:
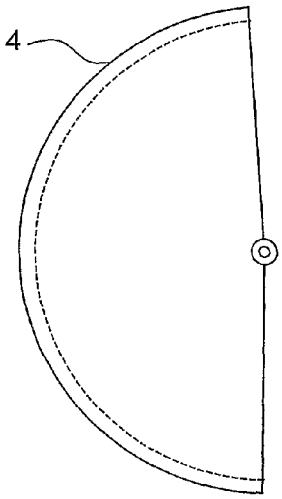
Figure 8B:
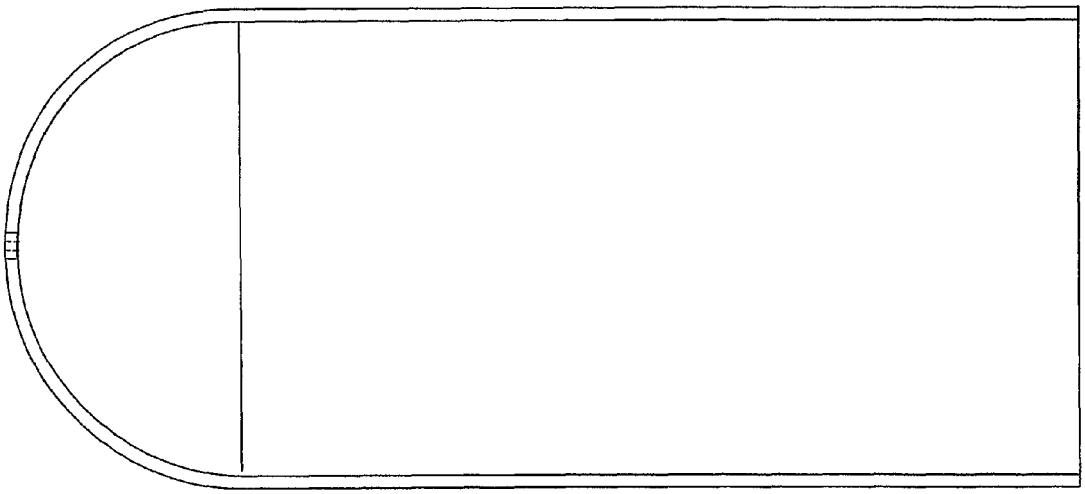
Figure 8C:
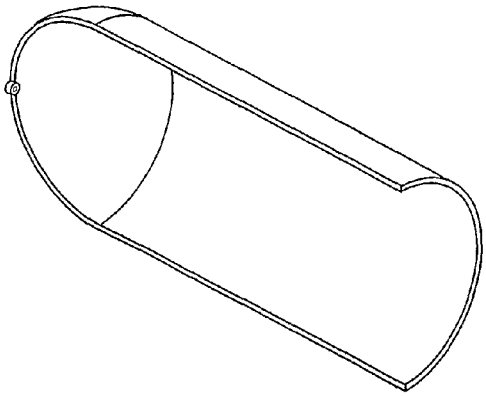
Figure 9A:
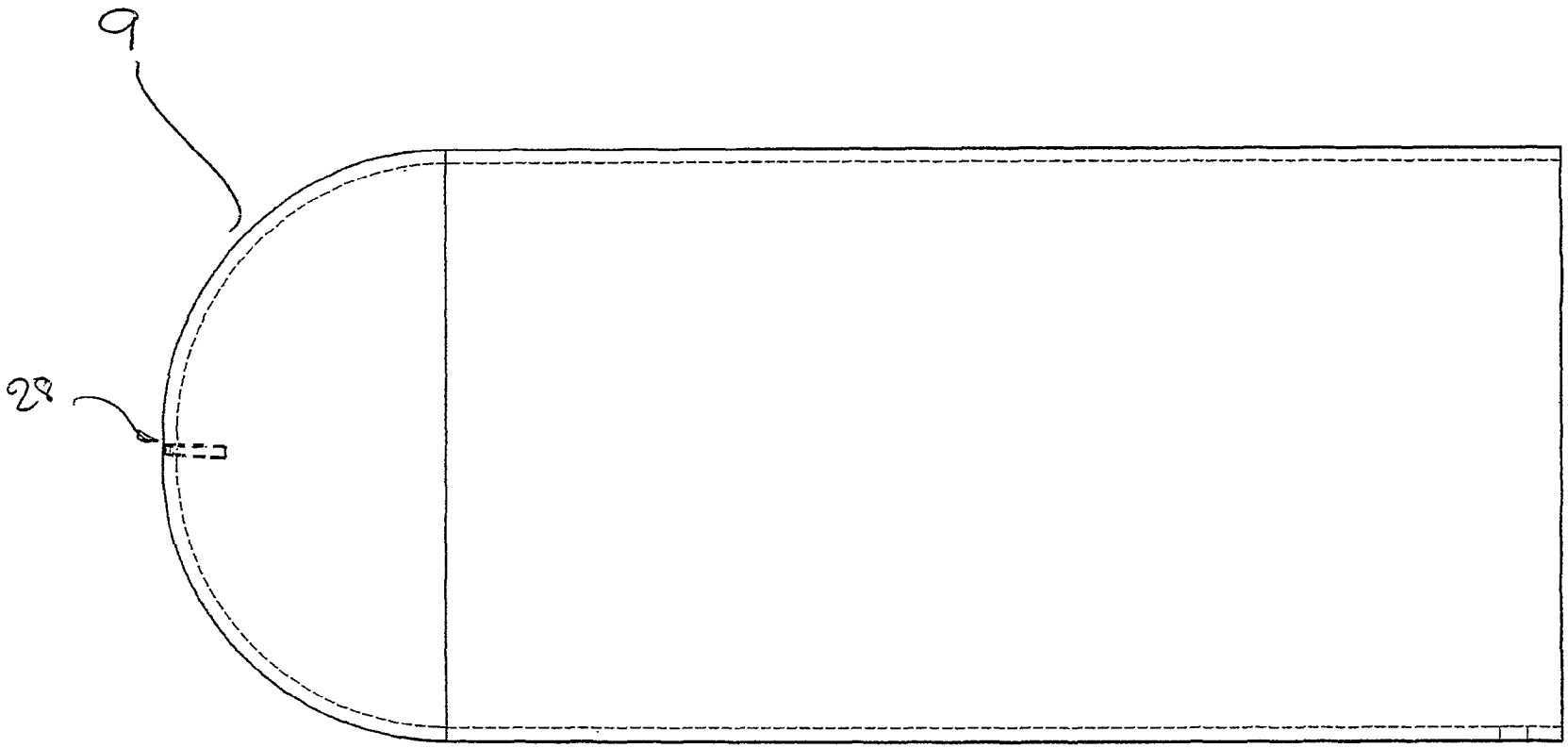
Figure 9B:
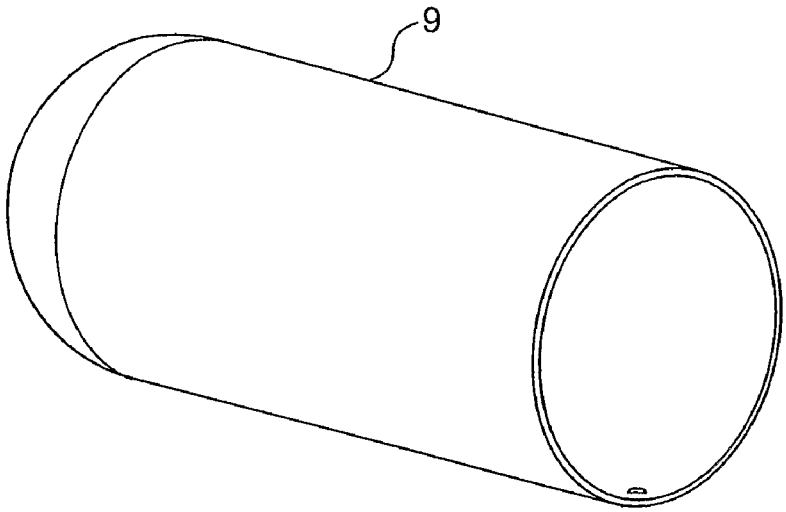
Figure 9C:
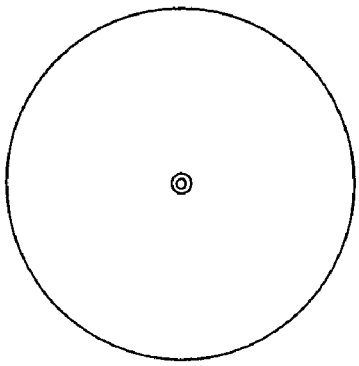
Figure 10A:
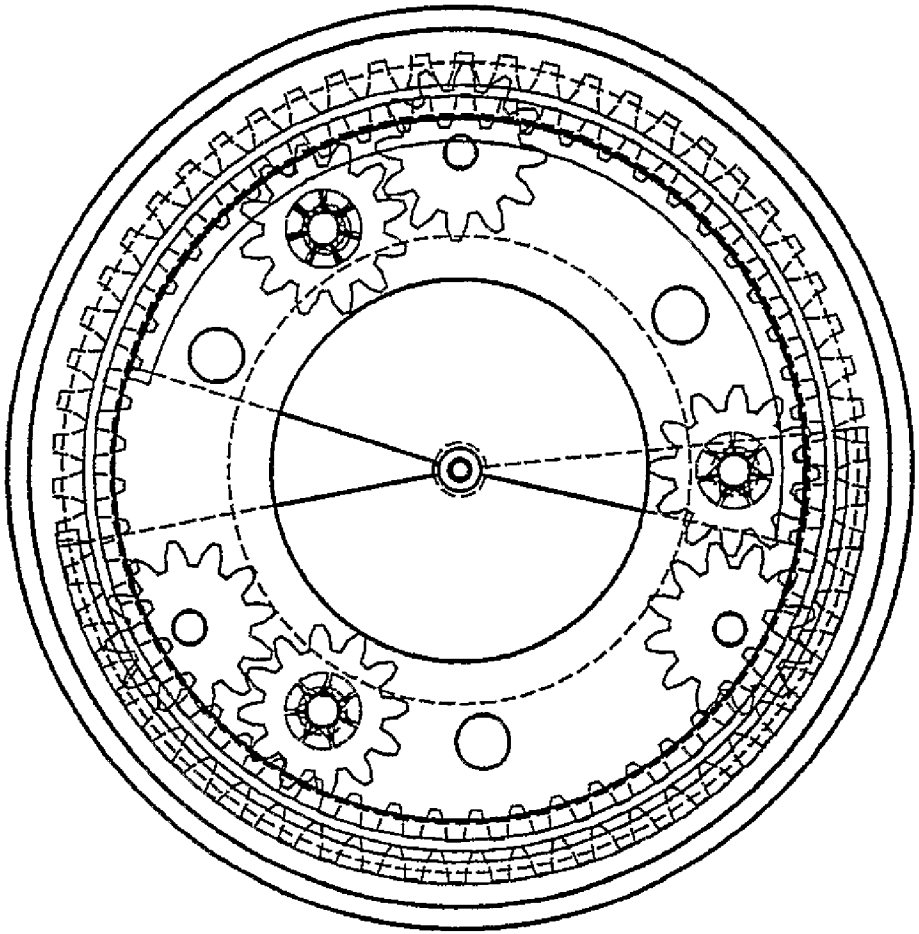
Figure 10B:
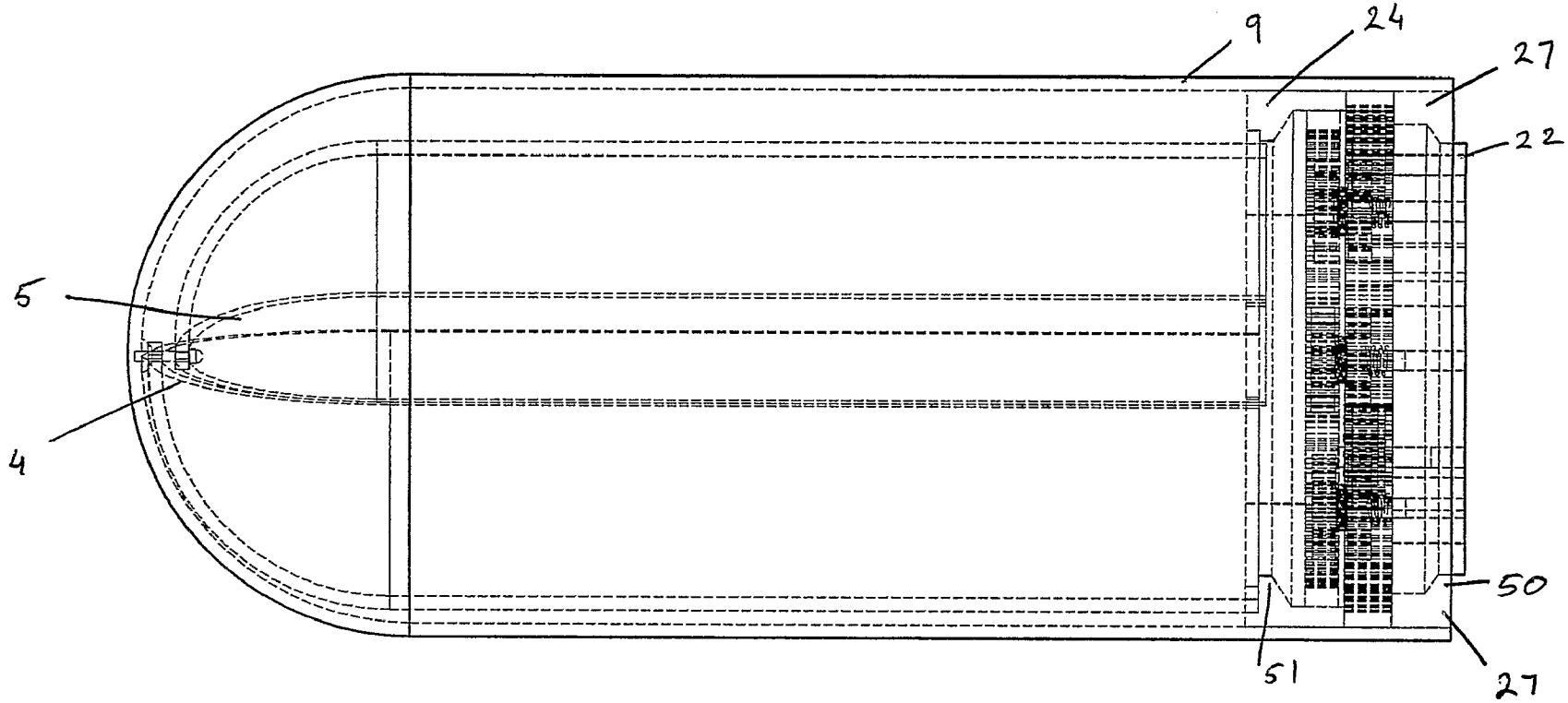
Figure 11:
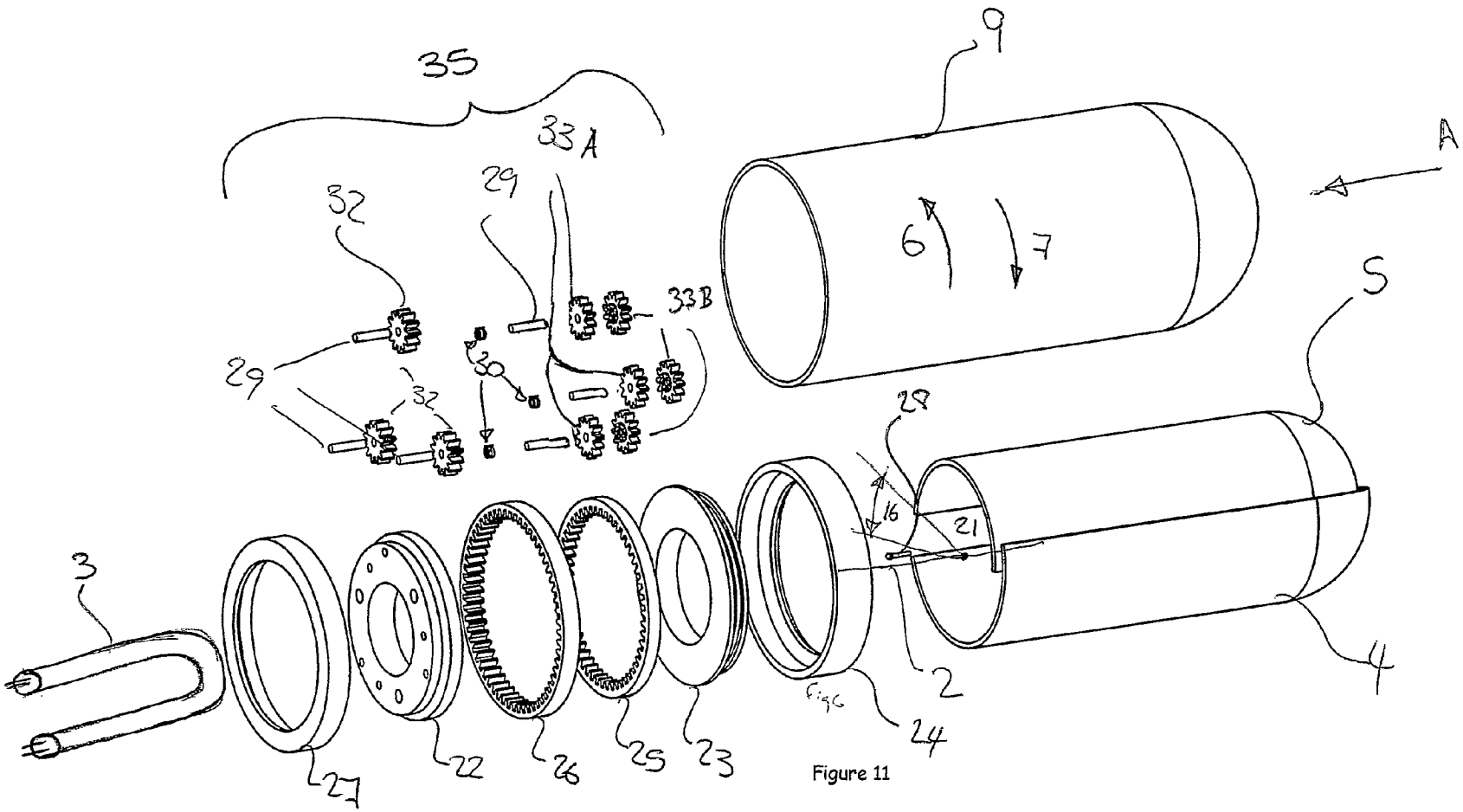
Figure 13B:
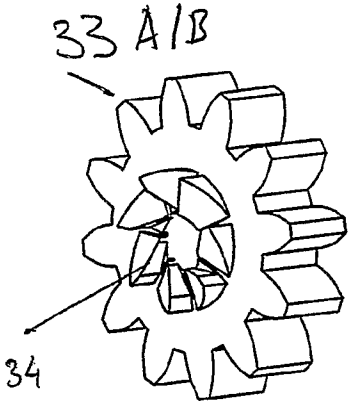
Figure 13C:
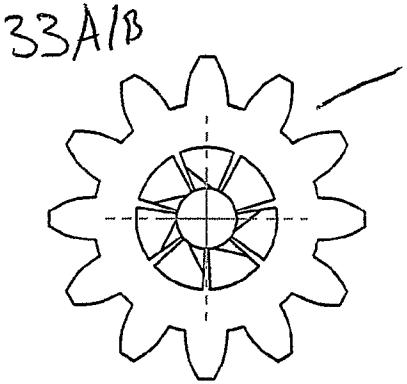
Figure 13A:
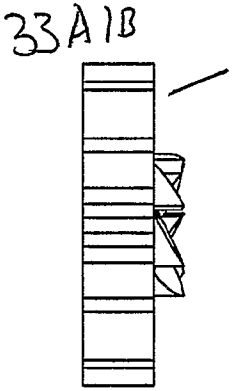
Figure 13D:
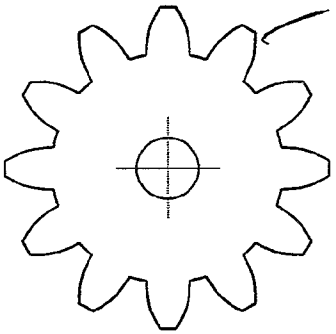
Figure 12A:
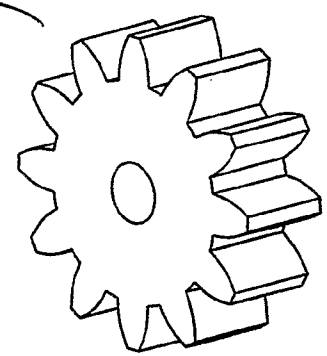
Figure 12B:
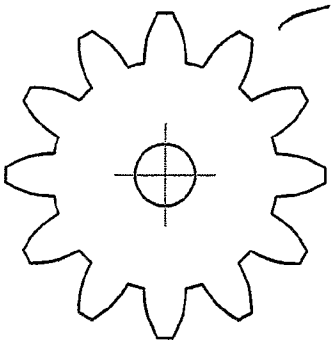
Figure 12C:
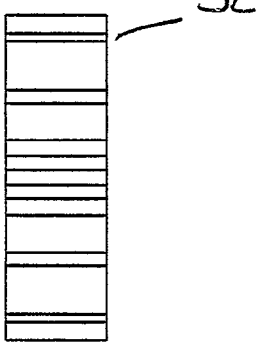
Figure 14A:
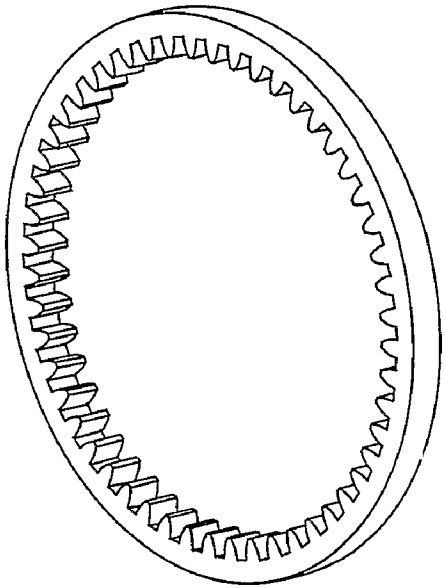
Figure 14B:
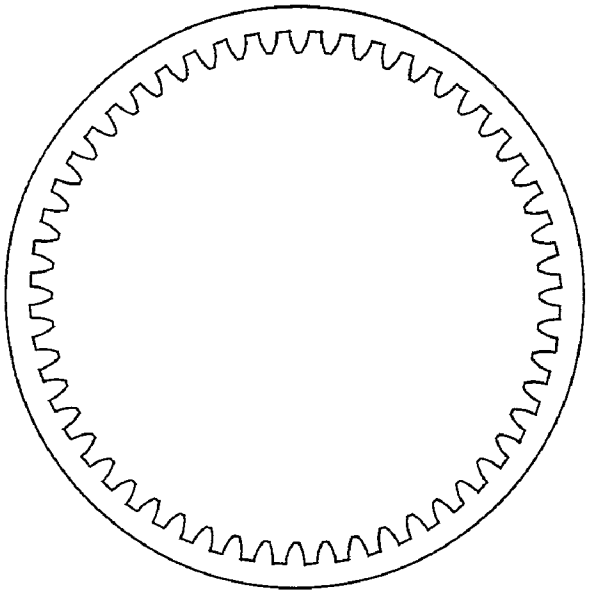
Figure 18:
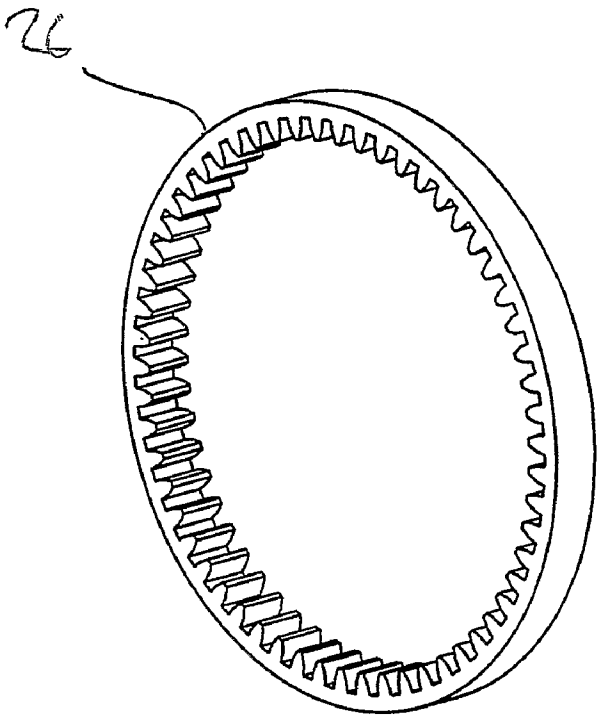
Figure 18:
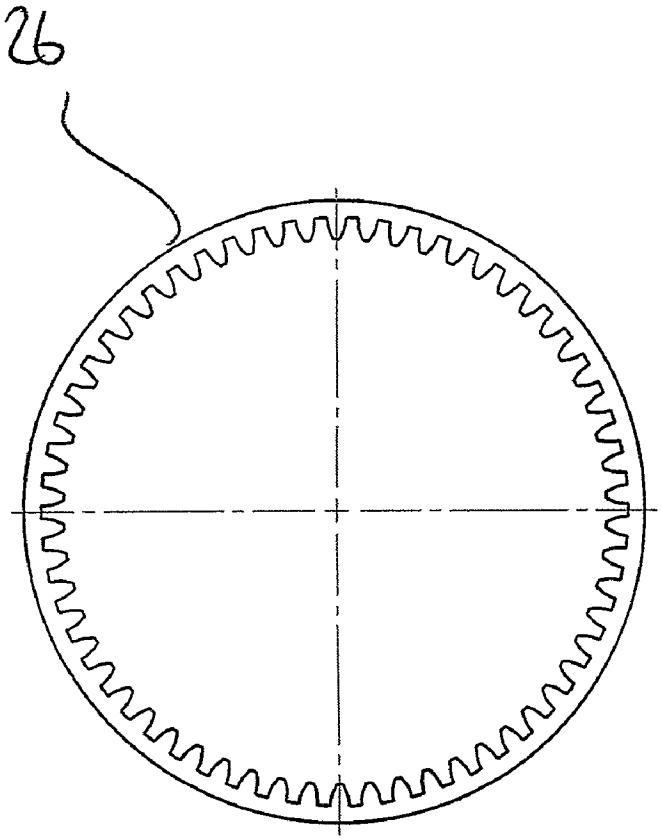
Figure 19:
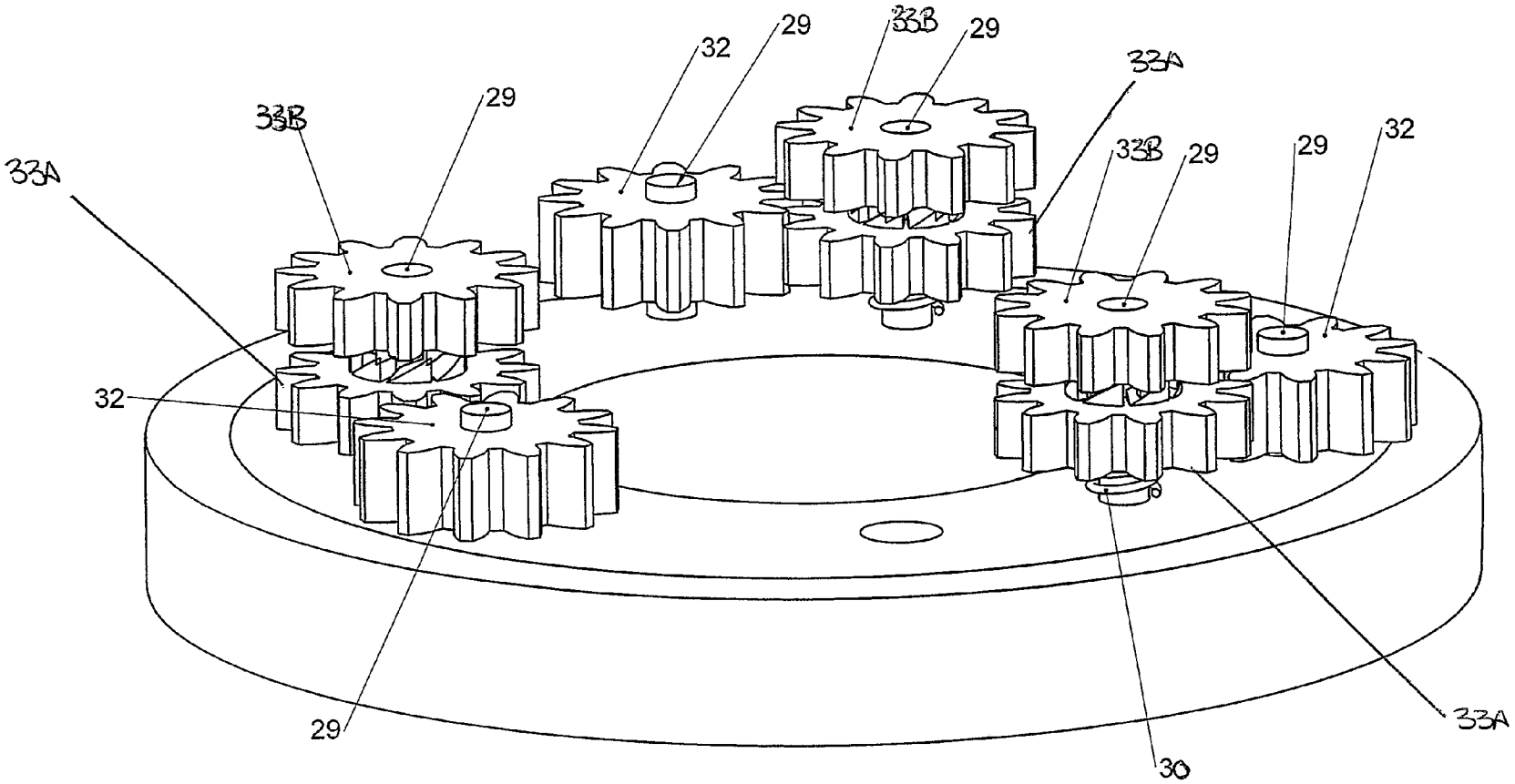
Figure 20:
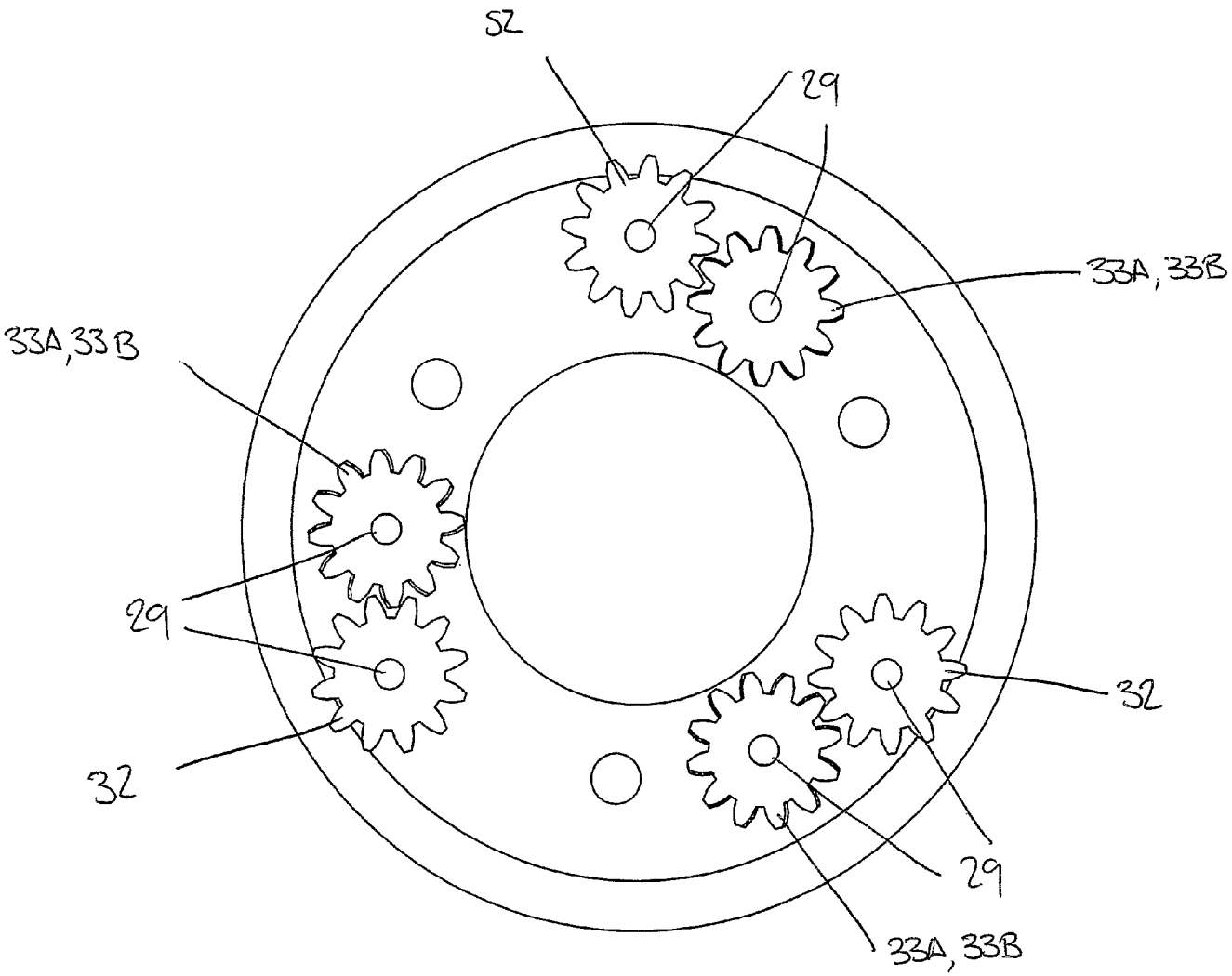
Figure 21:
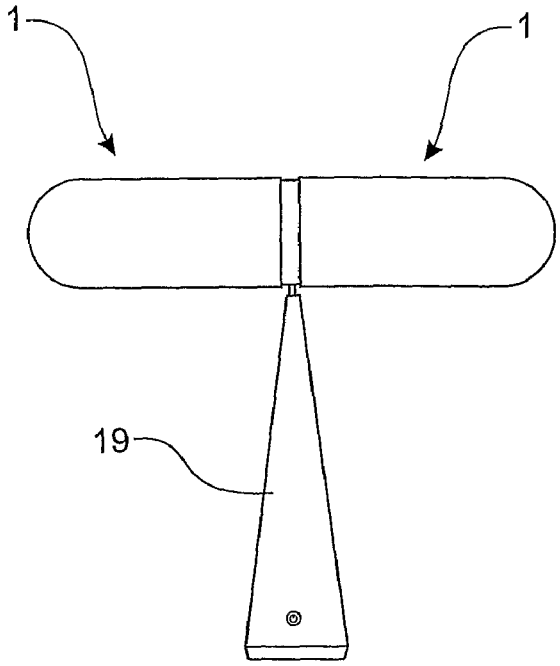
Figure 21:
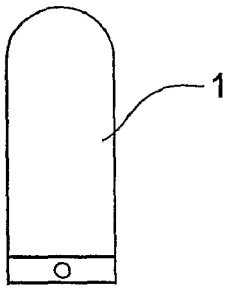
Figure 21:
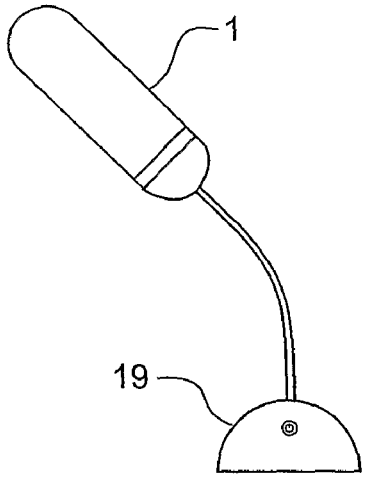
Figure 21:
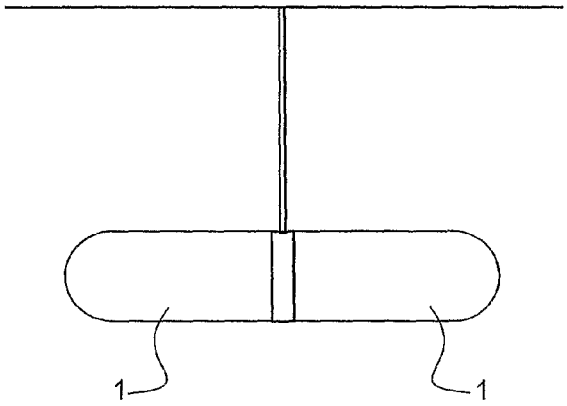
Figure 21:
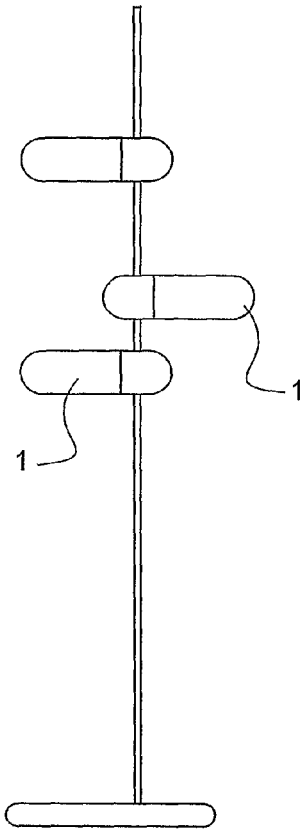
Figure 21:
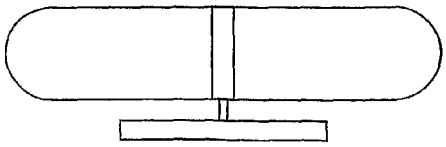
Figure 21:
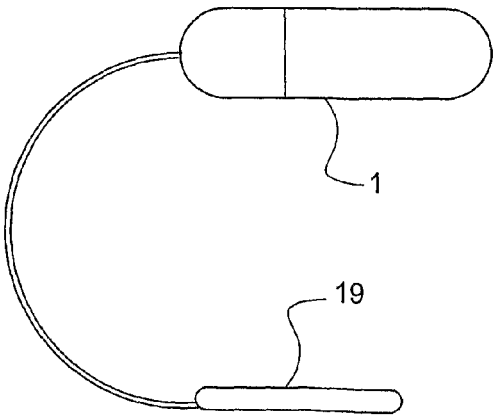
Figure 22:
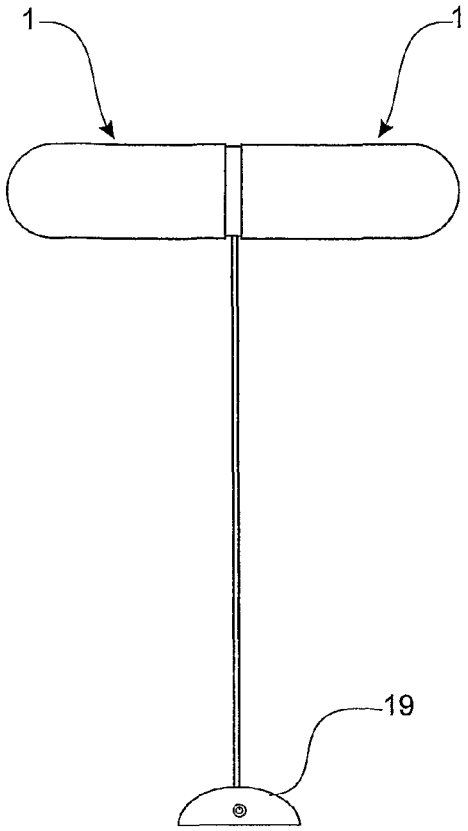
Figure 22:
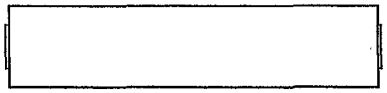
Figure 22C:
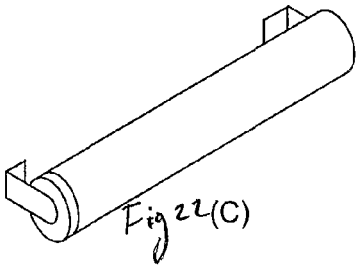
Figure 23:
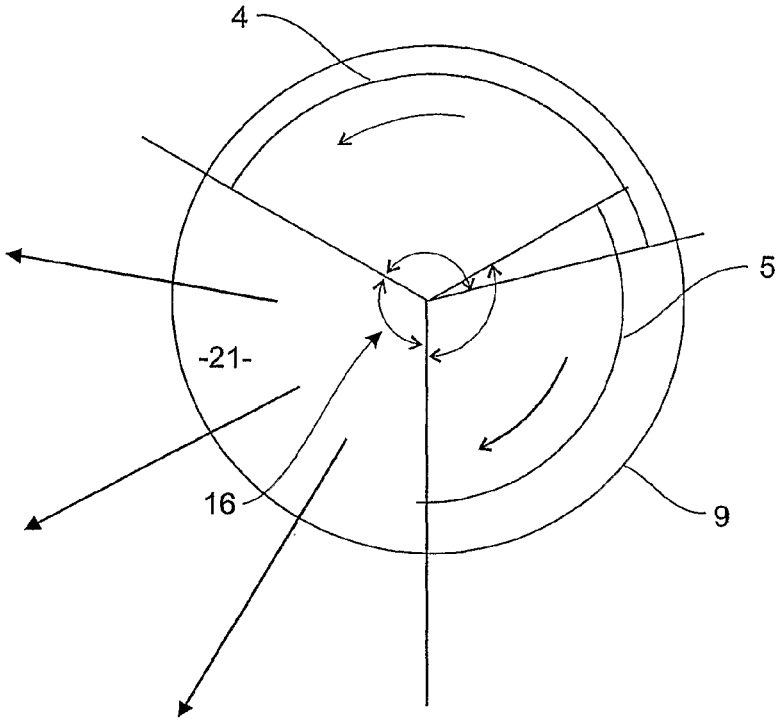
Figure 24:
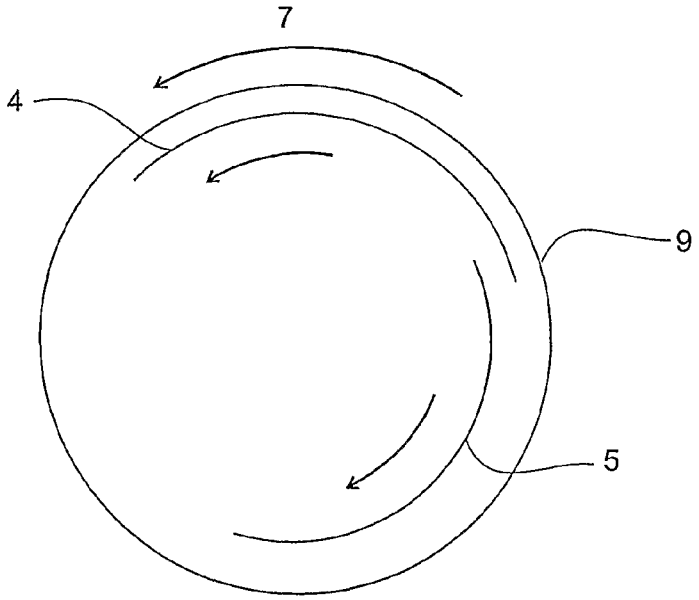
Figure 25:
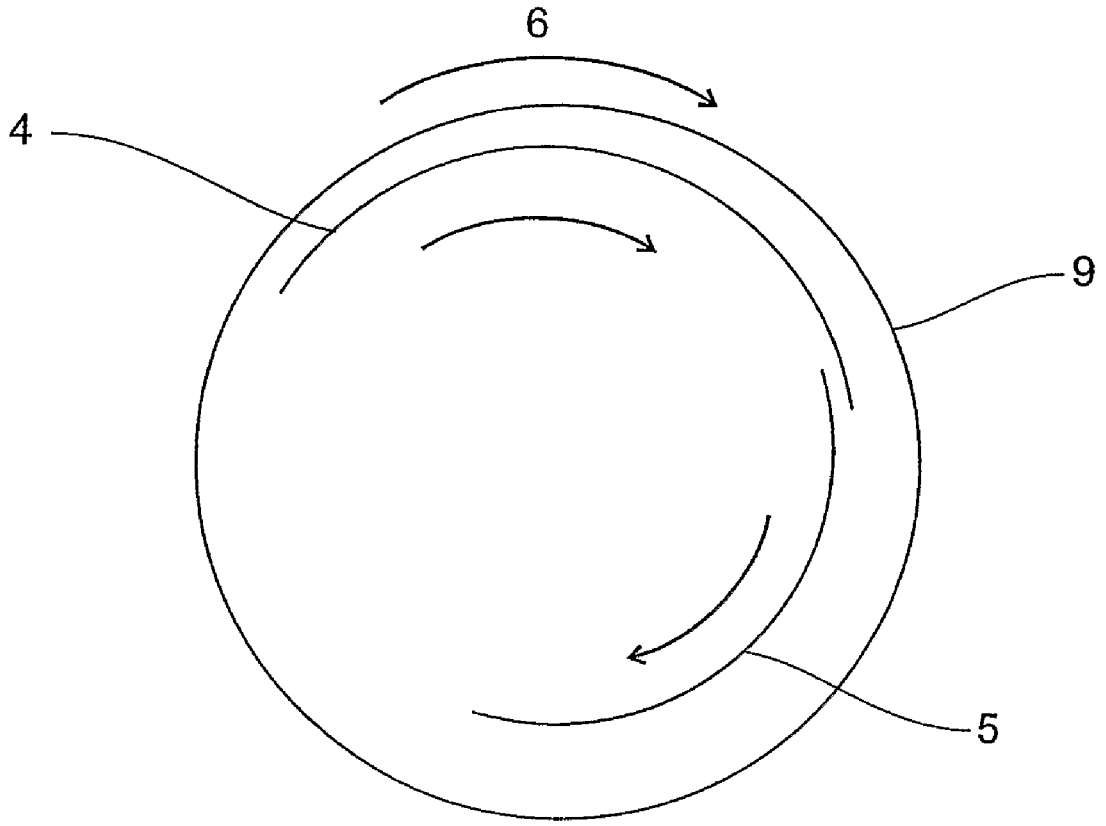
Figure 26:
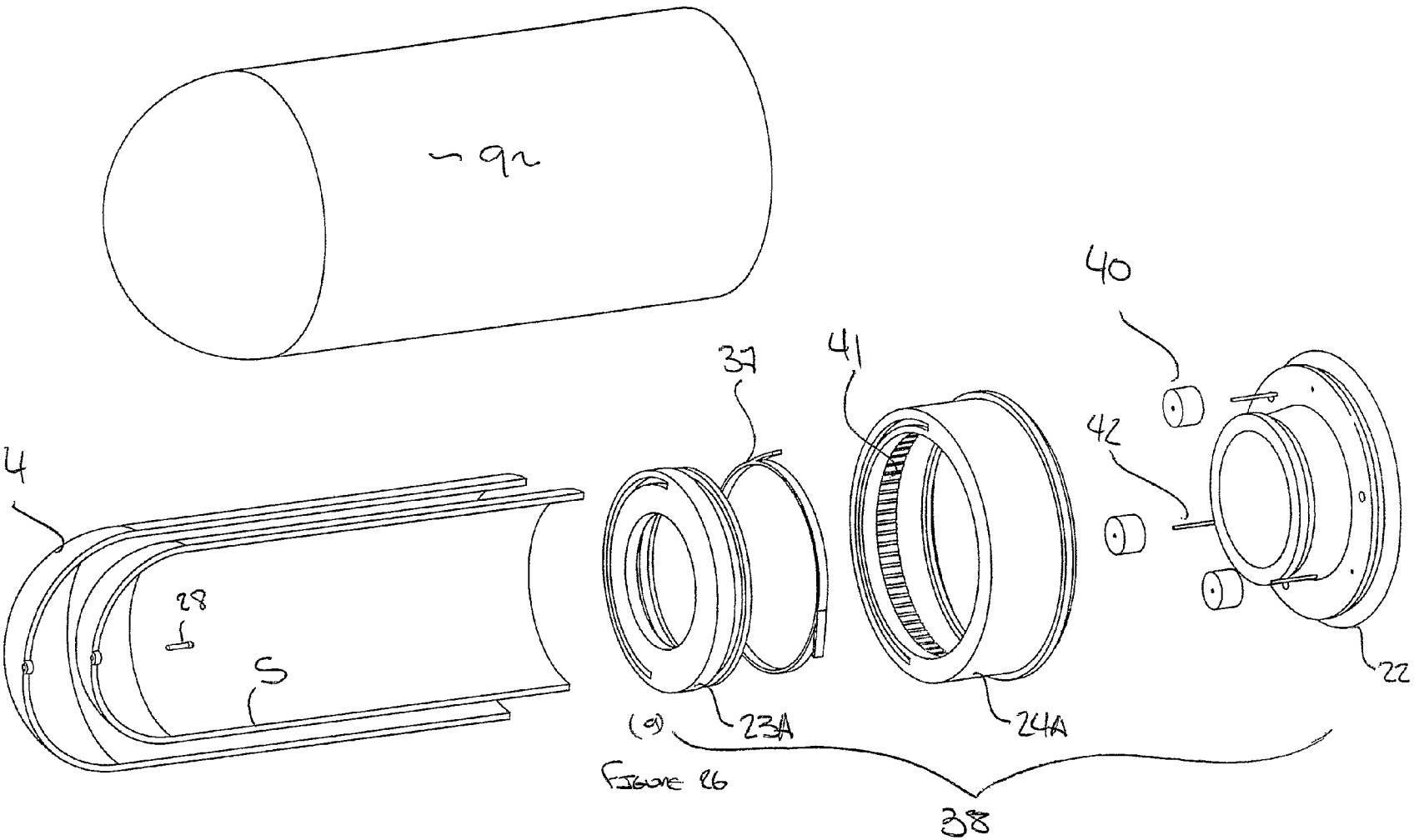
Figure 28:
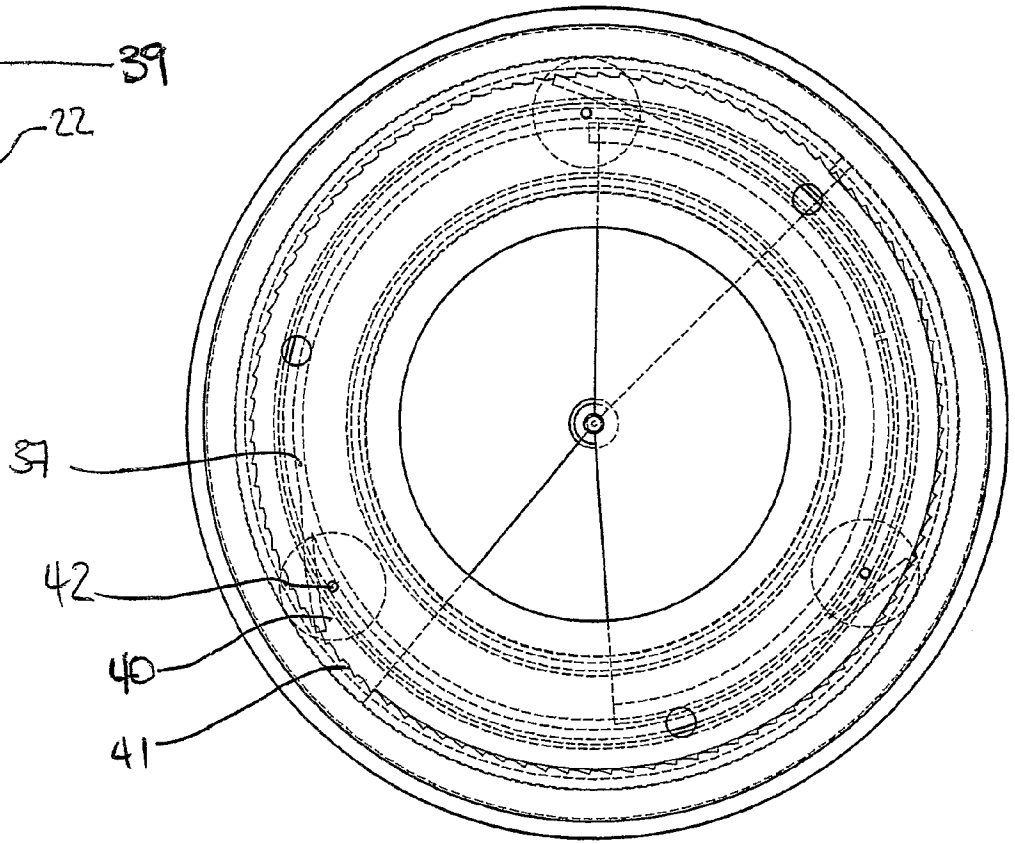
Figure 27:
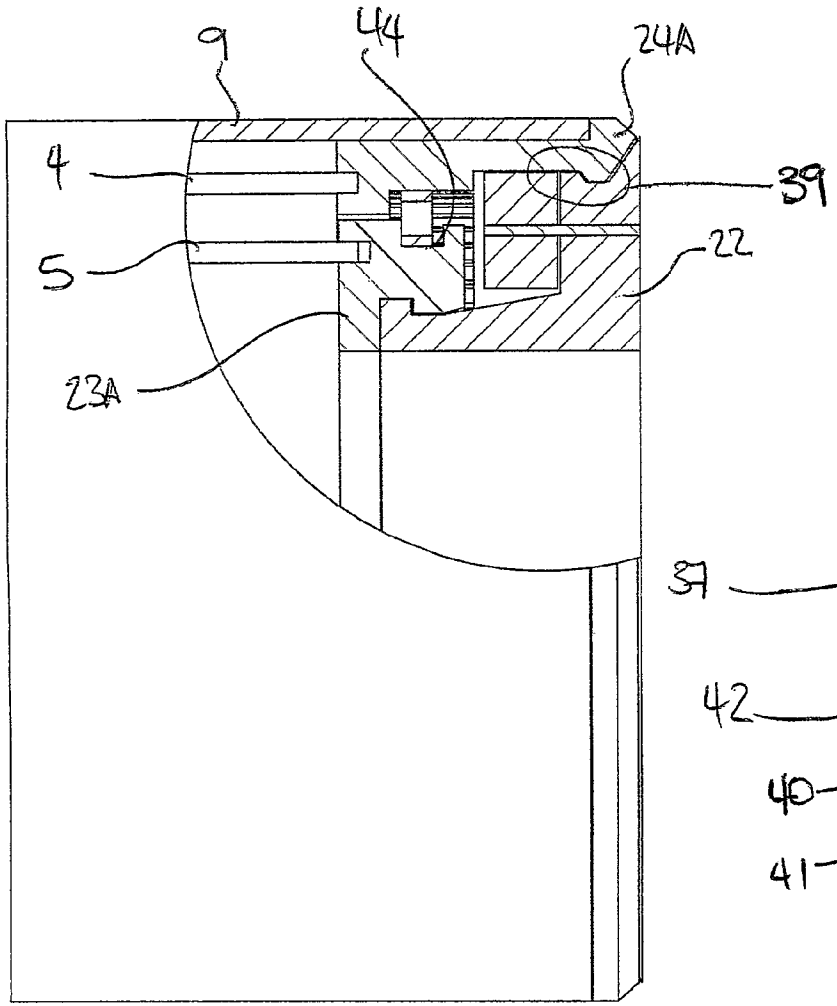
Figure 29:
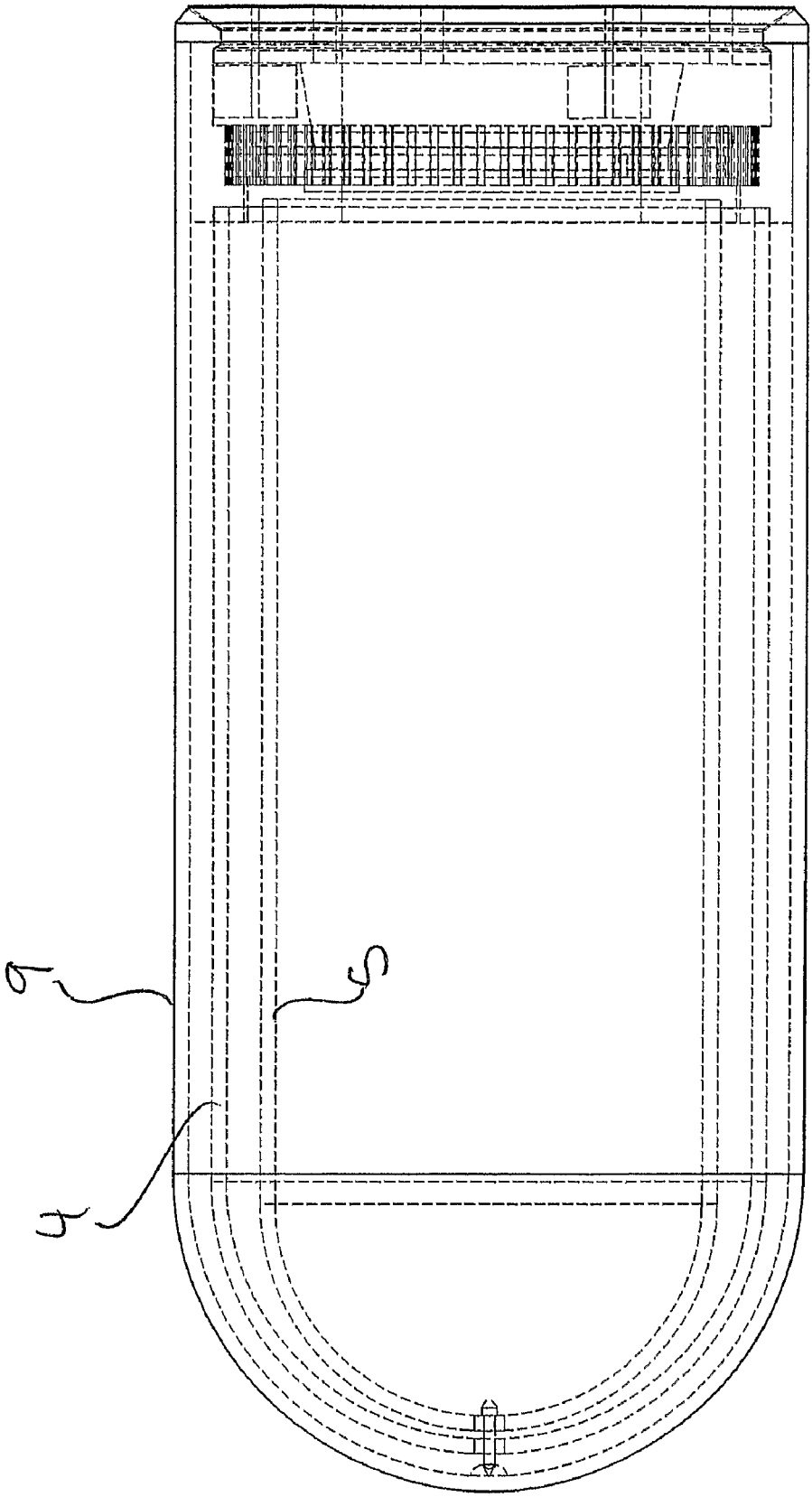
Figure 31:
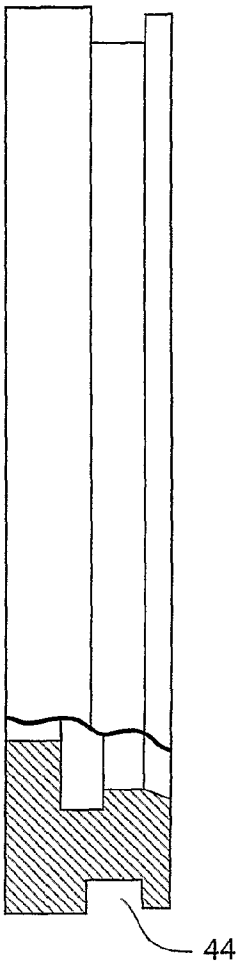
Figure 31:
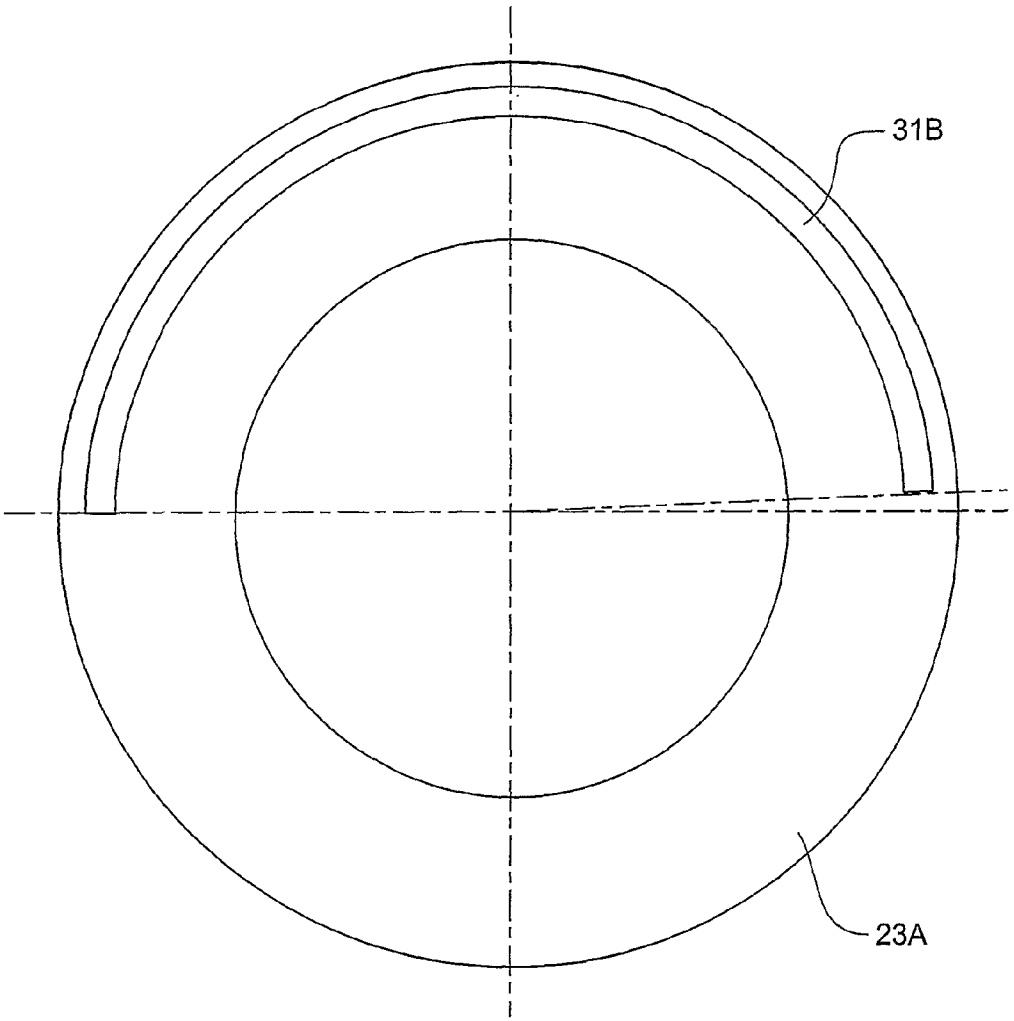
Figure 32:
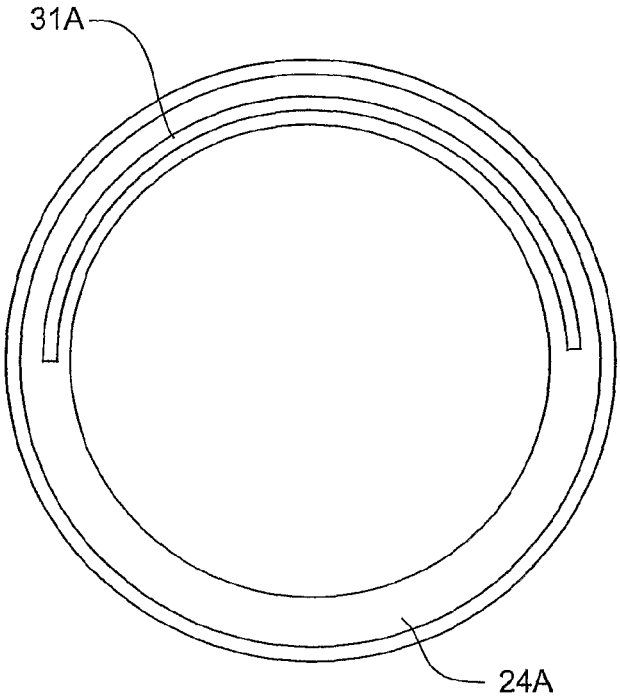
Figure 32:
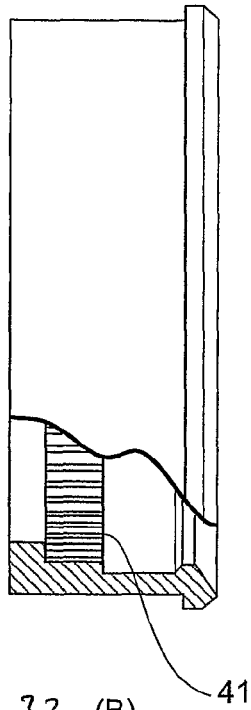
Figure 33:
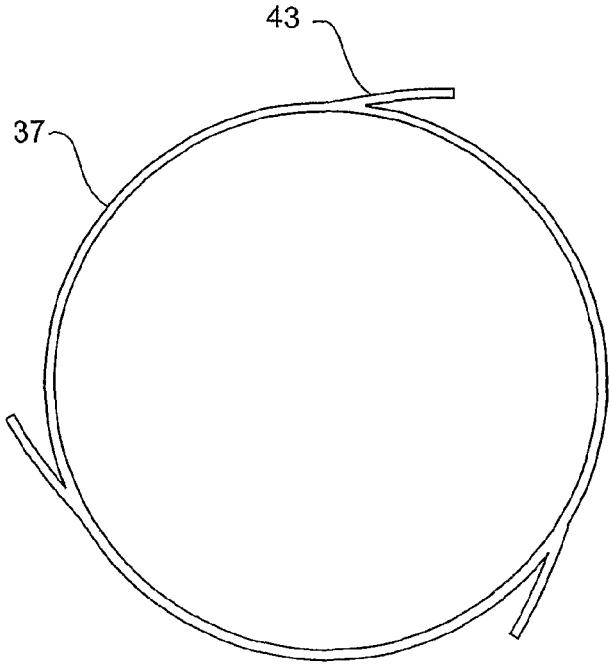
Figure 33:
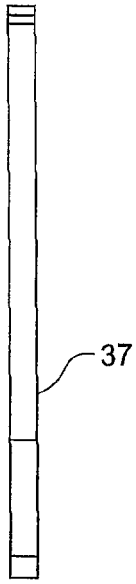
Figure 33:
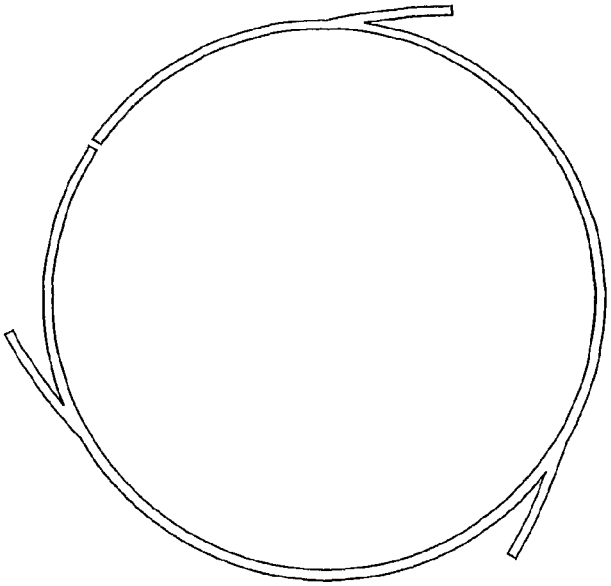
Figure 33:
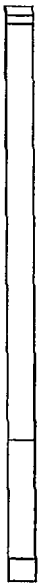
Figure 33:
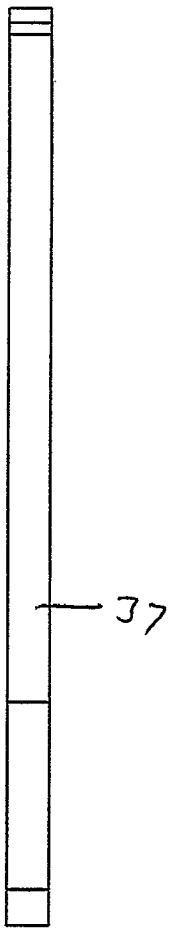
Figure 33:
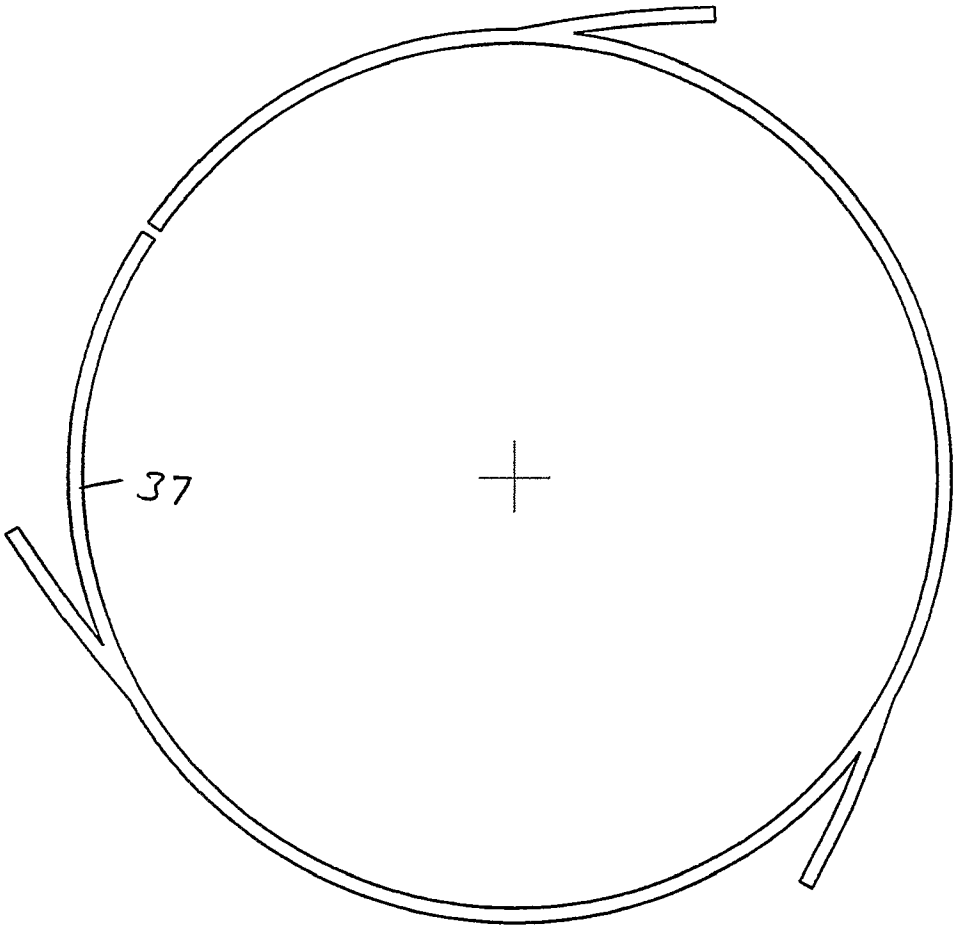
Figure 34:
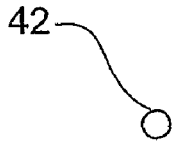
Figure 34:
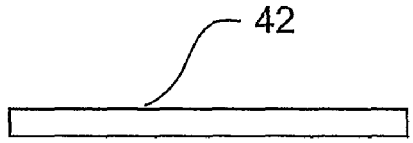
Figure 34:
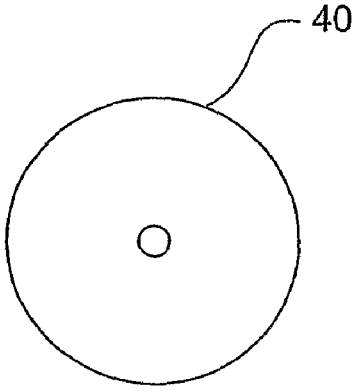
Figure 34:
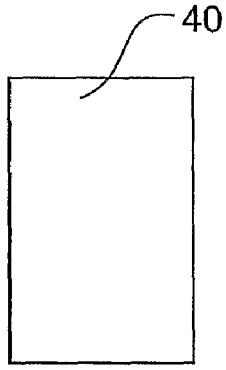
Figure 35:
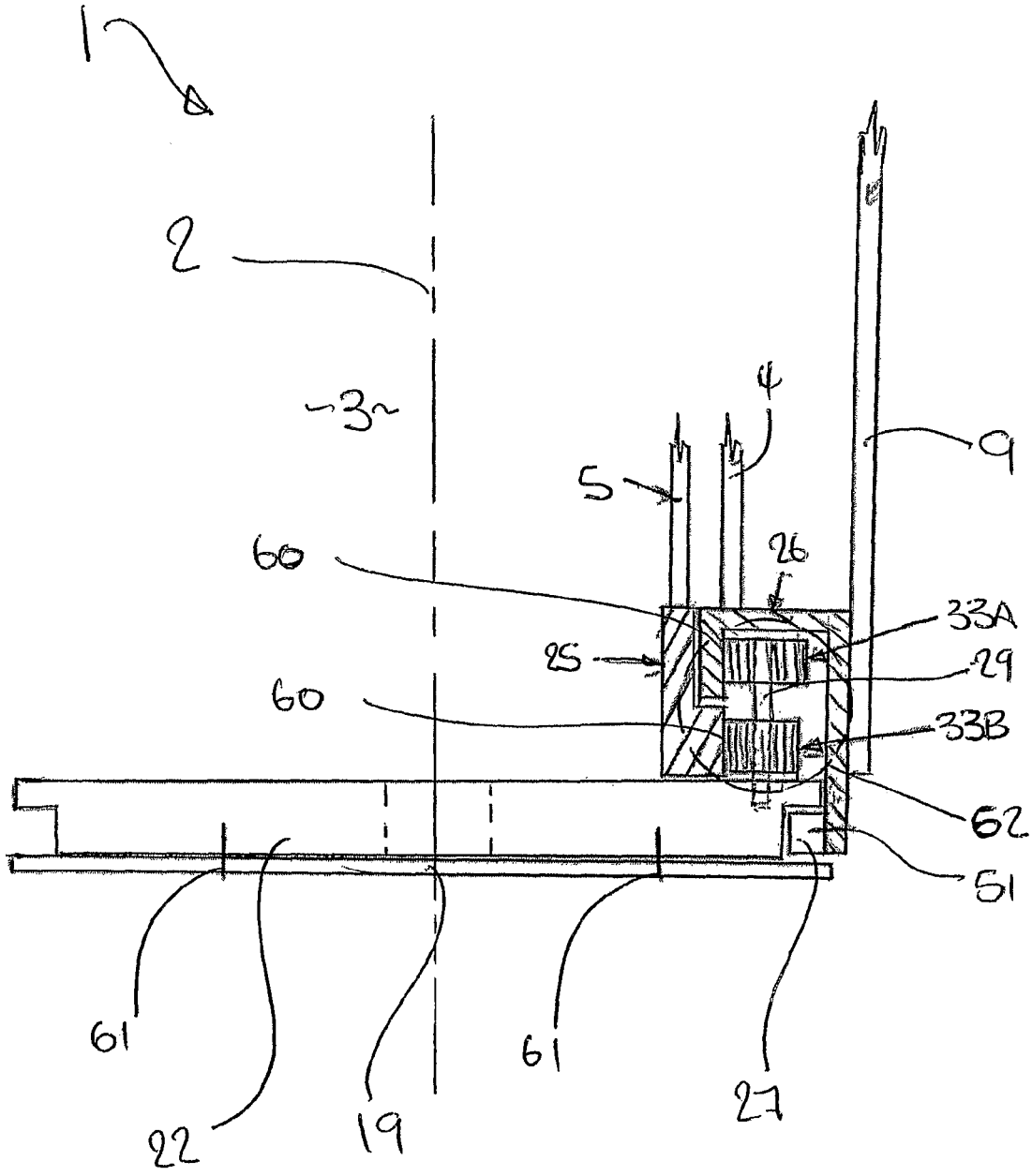
Figure 36:
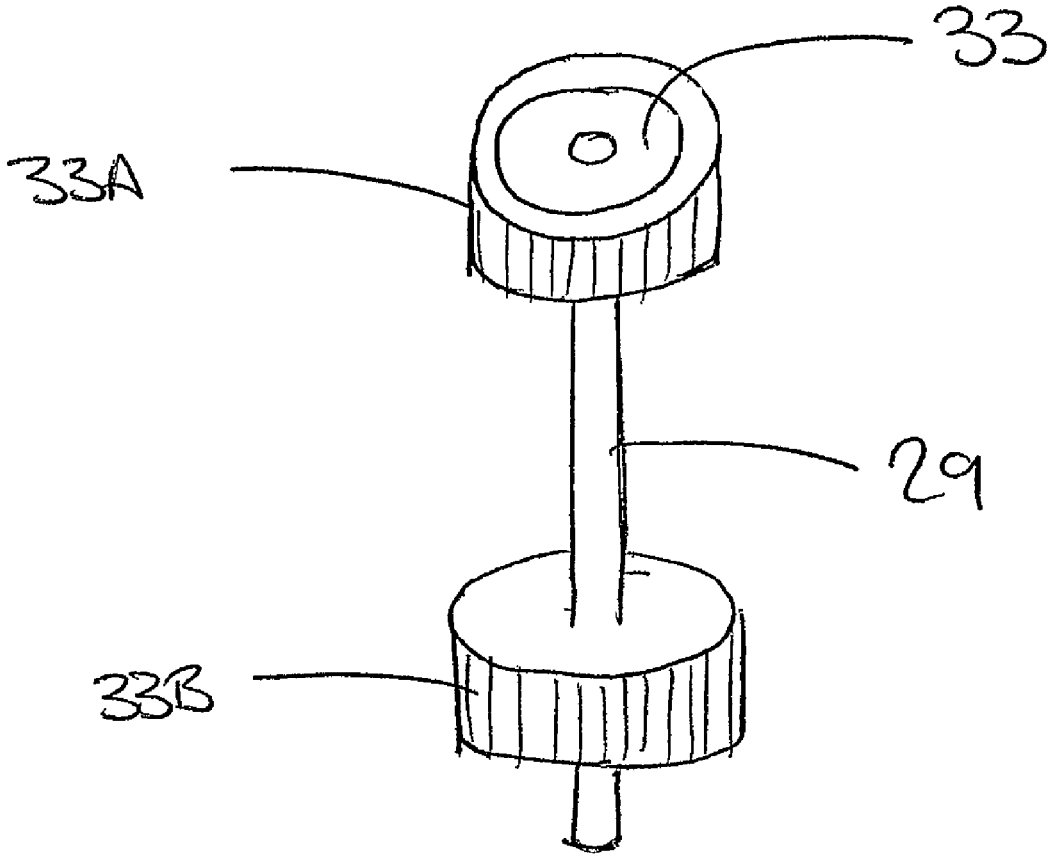

With reference to FIGS. 1 through 36 there is shown preferred embodiments of the present invention, whereby, FIG. 1A-C show three views of one embodiment of the present invention in a free standing table lamp format, FIG. 2A-C show three views of the lamp unit and its aperture control mechanism, FIG. 3A-C show three views of the bearing member, FIG. 4A-C show three views of the inner mount ring, FIG. 5A-B show two views of the outer connector ring, FIG. 6A-C show three views of the outer mount ring, FIG. 7A-C show three views of the inner (second) reflector, FIG. 8A-C show three views of the outer (first) reflector, FIG. 9A-C show three views of the outer shell, FIG. 10A-B show two views in partial phantom detailing of the whole assembly of one embodiments of the aperture control mechanism of the lamp, FIG. 11 shows an exploded assembly of FIG. 10, FIG. 12A-C show three views of an first inner planetary cog, FIG. 13A-D show four views of a second inner planetary cog, FIG. 14A-B show two views of inner ring gear, FIG. 15A-B show two views of a clutch spring, FIG. 16A-C show three views of a cog axle, FIG. 17A-C show three views of a reflector axle, FIG. 18A-B show two views of the outer ring gear, FIG. 19 shows in perspective view the gearing and clutch arrangement mounted to the bearing member, FIG. 20 is the same as FIG. 19 but showing the bearing member and gearing arrangement in end view, FIG. 21A shows a desk lamp configuration with two lamp units, FIG. 21B shows a lamp unit that may sit on a surface of may be surface mounted, FIG. 21C shows a lamp unit on a flexible stand, FIG. 21D shows the lamp unit as a pendant or suspended lamp, FIG. 21E shows a plurality of lamp units on a stand, FIG. 21F shows the lamp unit in a desk lamp configuration, FIG. 21G in still a further variation of a desk lamp, FIG. 22A shows a standard lamp that includes the lamp unit, FIG. 22B shows the lamp unit end mounted in front view, FIG. 22C is an isometric view of FIG. 22B, FIG. 23 shows the shell and reflectors in end on view from A in FIG. 11, to show the relative angles of components and the light aperture created, FIG. 24 shows some of the components and the effect of rotation of the shell in a second direction on the first and second reflectors to change aperture size, FIG. 25 shows a similar view to FIG. 24, but the effect rotation of the shell on the reflectors in the first direction to change the light cast direction, it should be understood that variation in the transmission system between the reflectors can reverse the relative direction or relative speed of the two reflectors for any one particular drive direction, FIG. 26 shows an exploded assembly in isometric of a second embodiment of the present invention, FIG. 27 shows a partial view in part section of the assembled second embodiment, FIG. 28 shows an end view of the second embodiment in part in phantom detailing, FIG. 29 shows a side view of the second embodiment assembly in partial phantom detailing, FIG. 30A-B show two views of the bearing member of the second embodiment, FIG. 31A-B show two views of the inner mount ring of the second embodiment, FIG. 32A-B show two views of the outer mount ring of the second embodiment, FIG. 33A-D show four views of the ratchet ring of the second embodiment, FIG. 34A-B show two views of a pin, FIG. 34 C-D show two views of a wheel, FIG. 35 shows in cross section along the main axis a third embodiment of the aperture control mechanism, where an outer ring gear can drive an inner ring gear via a transmission in one direction to control the angle of the aperture, and in the other direction does not drive the inner ring gear so that the size of the aperture is controlled and changed, the driving or non driving being controlled by a one way means, such as a Sprag clutch or similar, and FIG. 36 shows a close up of the rotation transmission with an upper input cog mounted to an axle via a one way means, in this case a Sprag clutch or similar, and a lower output cog also mounted to the axle.

The present invention relates to a shading or light control system for a light or lamp (1). The lamp (1) includes a shell (9) that has or defines a main axis (2). It contains one or more light sources (3).

Arranged to concentrically rotate about the main axis (2), is the shell (9), a first reflector (4) and a second reflector (5). Within the reflectors (4,5) is the source of light (3) and any electrical fittings therefore.

The lamp (1) via its shell (9) can be attached or affixed to other components at a stationary mounting (10) as shown in FIG. 1. The stationary mounting (10) may be the bearing member (22) or engaged to the bearing member (22) that will herein after be described. As shown in FIG. 1, two lamps (1) may be mounted by the stationary mounting (10). The mounting (10) in turn may be attached to a base (19) and the base may have a switch (20) for one or more of the light sources present. The base (19) may sit on a flat horizontal surface (18) or may be attached to a non-horizontal surface.

The shell (9) preferably defines an encompassing enclosure. It may be clear or have any degree of translucency or opacity as required. It may have variable translucency or opacity. The translucency may be achieved by frosting or other ways known in the art. The shell (9) may in addition be coloured. The reflectors (4) and (5) likewise may be opaque, translucent or have zones of different translucency and opacity and may also be coloured.

The lamp (1) includes an actuation control mechanism that can control the movement of the reflectors (4,5) and the shell (9) if present. FIGS. 21 and 22 show a number of different mounting options for the lighting system.

Preferred components and forms of the actuation control mechanism for the reflectors will now be described in relation to three preferred embodiments of such.

A preferred first embodiment of the actuation control mechanism will now be described with reference to FIGS. 1 through 25.

The shell (9) is engaged to a bearing ring (27). Such engagement may be permanent (e.g. by use of fasteners (62) or adhesive) or temporary (eg by frictional engagement). The bearing ring (27) may also be integrally formed with the shell (9). The bearing ring (27) rotates with the shell (9). The bearing ring is journalled for rotation relative to the bearing member (22). The bearing ring (27) may include a lip (50) to capture the bearing member (22) relative to the shell (9).

In the preferred embodiment the shell (9) is able to be removed from the bearing ring (27) yet be in a tight fit relationship thereto, so as to transfer rotational movement of the shell (9) to the bearing ring (27). The bearing ring (27) may itself be captured between the bearing member (22) and the mounting (10) and be freely rotatable relative to both. Alternatively the shell (9) may be directly journalled to the bearing member (22) and/or the mounting (10).

The journaled but removable relationship between the shell (9) and bearing member (22) enables access to the internals of the lamp (1), for example when changing the light source (3).

The bearing ring (27) is preferably the axially outer most component of the mechanism.

The input ring gear (26) is affixed or otherwise held stationary to the shell (9). It is driven about the axis (2) by rotation of the shell (9). It may be fastened to the bearing ring (27) and/or the shell (9). The input ring gear (26) includes an internal annular gear. The input ring gear (26) in turn is connected to the first reflector mount (24) which is preferably a ring shaped member. The first reflector mount (24) is engaged to or has a connection to the first reflector (4) so that they remain rotationally stationary to each other. The input ring gear (26), rotatable about the axis (2) in turn rotates the first reflector mount and hence the reflector about the axis (2).

The first reflector (4) in this configuration, rotates in sync with the shell (9). Indeed the rotation of the input ring gear (26) may be as a result of the first reflector (4) being mounted in a fixed and drivable relationship with the shell (9). The first reflector (4) may be part of the shell (9). The first reflector mount (24) may be affixed to the shell (9) or have frictional engagement therewith to hold it stationary to the shell (9).

The first reflector mount (24) may include a mounting aperture (31a) that the first reflector (4) is located into and can be locked into place. Such locking into place can be by pinning, gluing, screwing or a simple interference friction fit. The first reflector mount (24) may include a lip (51) to assist in its retention.

Thus rotation of the shell (9) in either direction will rotate the first reflector (4) in the same direction and at the same speed since it is essentially locked in this embodiment to the shell (9).

The second reflector (5) is supported to the second reflector mount (23). The second reflector mount (23) may be a ring shaped member. It may include an aperture (31*b*) to receive the second reflector (5). The second reflector mount (23) is connected to the output ring gear (25). The connection between the three is such that they rotate all as a single structure.

The single structure (25), (23) and (5) is supported to be rotational relative the first reflector, at one end by a reflector axle (28) co-axial with the main axis (2). The first reflector (4) may also pivoted about this axle (28). The axle (28) may be attached to the shell (9).

A gearing and clutch arrangement (35) as part of a rotation transmission, or transmission system is present and mounted to act intermediate of the input and output ring gears. The arrangement is supported by the bearing member (22). The bearing member preferably remains stationary to the mounting (10) and the first reflector (4) second reflector (5) and shell (9) may rotate relative thereto and about the axis (2).

The gearing and clutch arrangement (35) acts as a transmission system between the outer ring gear (26) and the inner ring gear (25). Depending upon the rotation the transmission system is driven in, the one way apparatus (e.g. the clutch) will be operative and engaged, or non-operative and disengaged. In the same way, the clutch depending upon rotation direction, will couple the drive components of the transmission system together or decouple the components when driven in the opposite direction.

The arrangement (35) transmits rotation of the shell (9) to the second reflector (5) as will now be described.

There is provided at least one set (three in the preferred instance) of a driving cog (32), and an input cog (33A) and a output cog (33B) with a one way system therebetween, such as a clutch (34).

The input and output cogs and the driving cogs are each mounted via cog axles (29) to the bearing member (22). In the preferred embodiments these cog axles (29) are parallel to the main axis (2).

The driving cog (32) has teeth that mesh with and run on and inside the input ring gear (26). The driving cog (32) therefore can co-rotate with the input ring gear (26) and therefore the same direction as the shell (9).

For each set, mounted for rotation preferably on a pitch circle diameter inward (and in this embodiment in substantially the same plane) of the driving cog (32) is a meshing input cog (33A). The input cog (33A) rotates in opposition to the driving cog (32).

An output cog (33B) is mounted on the same PCD as that of input cog (33A). A one way relationship (for example clutched) exists between the input cog (33A) and output cog (33B) that may for example include a ratchet (34). The clutched relationship facilitated by the ratchet allows for coupling (operational) when rotated in one direction and decoupling (non operational) when rotated in the other of the input and output cogs to occur.

The output cog (33B) in turn drives on the inside of the output ring gear (25). The output ring gear (25) therefore turns in the opposite direction (when allowed) to the input ring gear (26). The input ring gear (25) is concentric to, and axially spaced out from, the output ring gear (26).

Thus the inner or second reflector (5), since it is joined indirectly to the output ring gear (25) via the second reflector mount (23) will turn in the opposite direction to the outer or first reflector (4), when allowed by the transmission system being operative or coupled (eg clutch is engaged).

As stated a clutch relationship exists between the input gear (33A) and the output gear (33B). The coupled and uncoupled clutch relationship will ensure that in one direction of rotation, the input and output gears (33A and 33B) are coupled to each other to, for example, co-rotate with each other. In the opposite direction they can counter-rotate.

Alternatively they may be arranged to have two different rotational velocities, each relating to the coupled and uncoupled condition.

Therefore there is the ability of the input cog (33A) and output cog (33B) to rotate together (when the clutch couples the two together) or for one of either of the two to rotate independently of the other when the clutch decouples the two cogs.

In one form the clutched relationship may be provided by a ratchet (34). One of each of the cogs (33A and 33B) may include a ratchet surface that can mesh with a or a ratchet surface of the other cog. This is to occur in one rotational direction only. In the other rotational direction, the ratchet does not result in a coupling of the input cog (33A) with the output cog (33B). To encourage engagement of the clutch, the input cog (33A) is biased towards the output cog (33B). This may occur by a clutch spring (30). The clutch spring (30) can sit between the bearing member and the input cog (33A) and push the input cog (33A) against the output cog (33B) that in turn pushes against the second reflector mount (23). Alternatively the spring (3) may be located between the second reflector mount (23) and the output cog (33B) to push the output cog (33B against the input cog (33*a*) that in turn pushes against the bearing member (22).

The force that will disengage the clutch and result in co-rotation of the first and second reflectors, can be provided in a number of ways. In the preferred embodiment there is sufficient friction between parts mounting the second reflector mount (23) and the first reflect mount (24). The result is that the two reflectors will rotate at the same rotational velocity as the clutch will be disengaged. So upon rotation of the shell (9) in one direction that uncouples the clutch, there is sufficient friction between between the parts mounting the first and second reflectors, such as the mounts(23, 24) to overcome any drag friction of the clutch. This will vary the direction of the aperture, and thus light beam, between the two reflectors.

However when the shell (9) is rotated in an opposite direction relative to the bearing member (22) the clutch will engage to ensure a sufficient force is transmitted between the input cog (33A) and the output cog (33B) to overcome the friction between the first and second reflector mounts (24,23) and therefore will result in the first reflector (4) and the second reflector (5) moving in opposing directions to vary their relative angle (21) and thus vary the size of the aperture (16).

In other forms of the present invention the drive cog (32) may not be present and the input cog (33A) may be driven directly off the input ring gear (26). A person skilled in the art would understand that a variation made to the transmission system would then still achieve the actuation as above.

In other embodiments of the present invention the force to overcome the clutch mechanism may be provided by a ratchet or may be provided by an antagonistic gear system with an opposing clutch member.

The basic mode of operation of the preferred embodiment of FIGS. 1-26 is shown with reference to FIGS. 24 and 25. The user can grasp the shell (9) and rotate it in one of two directions about the main axis (2).

In the first direction (6) the first reflector (4) and second reflector (5) will rotate at the same speed together and in the same direction. This is due to the friction, whether direct or indirect as above, between the two reflectors overcoming the one way means, such as the clutch.

When the shell (9) is rotated in the opposite or second direction (7) the second reflector (5) will move so as to vary the relative angle (16) between the first reflector (4) and second reflector (5). This is due to the clutch engaging and a opposing rotation being imparted on the output ring gear (25) in comparison to the input ring gear (26) by the transmission arrangement therebetween.

In certain alignments (such as that shown in FIG. 11 and dependent on the angular arc over which each reflector extends) an aperture (21) will be created between the first reflector (4) and second reflector (5).

Thus the rotation of the shell (9) in the second direction (7) will vary relative position (16) of the two reflectors and create a variable size aperture (21) between the first reflector (4) and second reflector (5). When the shell (9) is rotated in the first direction (6) the resultant aperture (21) created can then be rotated in its angular position relative to the main axis. Thus a user may vary the amount of light that will be exposed via the aperture (21) and also the direction of that exposed light.

It will be understood by those skilled in the art that by substitution and variation of the clutch, cogs, ring gears, and surfaces upon which the cogs and rings gears drive the relative rotation velocity (both direction and speed of rotation) of the two reflectors can be infinitely varied. The above set of directions is an example only, and of course by the substitution and variation the opposite and other effects can be achieved.

With reference to FIGS. 26 through 34 a further variation of the actuation mechanism described in FIGS. 1-25 will now be described. The embodiment consists of a shell (9), first reflector (4) and second reflector (5). This is in turn mounted to a rotation assembly (38) and by a mount (10) can locate the system as is desired. In this particular embodiment the shell (9) and the first reflector (4) are linked to rotate in synchrony. The first reflector (4) may be part of the shell (9). In a similar fashion to the previous embodiment the second reflector (5) is connected to the second reflector mount (23A). The first reflector (4) is mounted to the first reflector mount (24A) to be rotatable thereby. Thus the assembly of the shell (9), first reflector (4), and first reflector mount (24A) can rotate independent of the second reflector (5) and second reflector mount (23A).

The first reflector mount (24A) is mounted and rotatable relative to the bearing member (22) via a peripheral clip (39). For ease of rotation, additional wheels (40) as bearings may be present to reduce the frictional load on the first reflector mount (24A). In turn these wheels (40) are mounted on pins (42). In an alternative embodiment there may just be a low frictional interface between first reflector mount (24A) and bearing member (22).

On the inner periphery of first reflector mount (24A) there is present ratchet grooves (41). Located internally and concentrically to the first reflector mount (24A) is a ratchet ring (37). The ratchet ring (37) is frictionally mounted to the second reflector mount (23A) in for example a groove (44). The nesting of these components is best shown in FIG. 27. The ratchet ring has ratchet arms (43) that engage with the ratchet grooves (41) when turned against the ratchet arms.

With sufficient friction between the ratchet ring (37) and the second reflector mount (23A), the ratchet ring (37) cannot rotate independently of the second reflector mount (23A). This may be achieved by having very little clearance between the inner diameter of the ratchet ring (37) and the outer diameter of the ratchet ring groove (44). Pinning or attachment of the ratchet ring (37) to the second reflector mount (23A) may also achieve this.

These is also friction present between the second reflector mount (23A) and a surface of the beating member (22) to overcome the drag of the ratchet ring (37) and ratchet grooves (41) interfacing.

Any rotational resistance force that may be resultant from contact between the ratchet arms (43) and the ratchet grooves (41) when turning in a slippage direction is less than rotational resistance such as from friction between the second reflector mount (23A) and the bearing member (22). Thus when the ratchet arms (43) are slipping the second reflector mount (23A) (and thus the second reflector (5)) do not move relative to the bearing member (22) whilst the first reflector mount does rotate relative thereto.

When the shell (9) (with the first reflector mount (24A)) is rotated in one direction so that the ratchet ring (37) slips on the ratchet grooves (41) because of the interface friction between the second reflector mount (23) and the bearing member (22), then only the rotational position of the first reflector (4) relative to the bearing member (22) is varied. This way the aperture (i.e. the relative angle (16) between the two) between the two reflectors can be varied.

When the shell (9) is rotated in the opposite direction the ratchet grooves (41) will engage with the ratchet ring (37) and thus the second reflector mount (23A) (and the second reflector (5)). Since the sub assembly of the shell (9) first reflector mount (24A) and first reflector (4), second reflector mount (23) and second reflector (5) are locked rotationally they rotate at the same speed and same direction. The first reflector (4) and second reflector (5) therefore rotate in synchrony. In this way the direction of cast light can be varied.

The bearing member (22) may include a light hole (46) which allows the source of light (3) to pass through to reside inside the shell (9).

A further variation of the invention is shown in FIGS. 35 and 36. Shown in cross-section along the main axis (2) is part of an input ring gear (26) that can drive an output ring gear (25) via a transmission (62). Attached to the input ring gear (26) is the first reflector (4) and attached to the output ring gear (25) is the second reflector (5). Also attached to the input ring gear 26) in this embodiment is the shell (9).

In this embodiment the shell (9) is what a user would normally grasp to actuate the aperture control mechanism. In other embodiments the aperture control mechanism may be actuated by a separate means, e.g. a band, lever or similar.

The light source is contained in the cavity between the first reflector (4) and the second reflector (5) as shown in other embodiments. The transmission (62) in this embodiment consists of an input cog (33A) and an output cog (33B) concentric on a common cog axle (29) that can transmit rotation from the input cog (33A) to the output cog (33B) with a one way apparatus mounted between them. In the preferred embodiment this one way apparatus is a clutch, such as a ratchet or Sprag clutch. The cog axle (29) is mounted by the bearing member (22) so that the cogs (33A and 33B) can rotate about its axis.

The cogs (33A and 33B) mesh with respective gear teeth of the input ring gear (26) and output ring gear (25) When the input ring gear (26) is rotated in a first direction, for example clockwise, the input cog (33A) is driven to rotate in the counter-clockwise direction. The one way apparatus allow relative rotation (such as by slip) between the output cog (33B) and input cog (33A) so that the output cog (33B) does not move and hence the output ring gear (25) does not move either.

When driven this way the first reflector (4), mounted by the input ring gear (26), moves relative to the second reflector (5) that remains stationary relative the bearing member (22). In this way the relative angle (16) of the first reflector (4) and the second reflector (5) is varied to change the width of the beam of light projected from the lamp (1).

When the input ring gear (26) is rotated in a second direction opposite to the first, for example counter-clockwise, the input cog (33A) is driven to rotate in the clockwise direction. The one way apparatus becomes operative transmitting the rotation of the input cog (33A) to the output cog (33B), which is then also driven in the same direction, i.e. clockwise.

In turn the output ring gear (25) is driven to rotate in the counter-clockwise direction. The second reflector (5), mounted from the output ring gear (25), therefore moves in a counter-clockwise direction also.

The gearing ratio of the input ring gear (26) to the input cog (33A) and the output cog (33B) to the output ring gear (25) is preferably the same. Therefore the input ring gear (26) and the output ring gear (25) will turn at the same rate in the same direction when the one way apparatus of the transmission (62) is engaged, i.e. counter-clockwise in the above example. In this way the angle or direction of the beam from the lamp is varied.

In the preferred embodiment there is more than one transmission (62) present. There may for example be three transmissions (62) spaced equally about the main axis (2).

As will be understood the one way apparatus can easily be reversed from the above example and thus the directions will simply reverse also.

In other embodiments the input ring gear (26) may be driven in one direction and transmission (62) may drive the output ring gear (25), when the one way apparatus is engaged, in the opposite direction. This may occur when there is an extra gear between (33A) and (33B) so they are driven in opposite directions. For example the input cog (33A) may be mounted on a different axle to the output cog (33B) and an intermediate cog may be provided intermediate. The input and output cogs (33A, 33B) may then rotate in the opposite directions. Alternatively it may occur when one cog, either the input or output cog is driven or drives on the outer surface (rather than inner as shown here) of its respective ring gear.

It will be appreciated that in this way when the input ring gear (26) is driven in one direction both the first and second reflectors (4) and (5) can rotate in the same direction relative the beating member (22) but at different speeds so as to change at least the aperture size. When the input ring gear is driven in the opposite direction the one way apparatus slips due to a frictional engagement present between the input ring gear (26) and the output ring gear (25) and only the cast light direction is changed.

so that they rotate together in that direction. In this way the angle or direction of the beam from between the first reflector (4) and second reflector (6) can be varied. The invention may be implemented in a number of other ways. By way of example, but not limited to a few variations will now be described.

The first reflector (4) may be adhered to or be part of or be defined by of the shell (9) itself.

The shell (9) may not be present and instead, the first reflector is grasped to effect rotation.

Shell rotation and/or first reflector rotation may be effected, rather than by turning of the shell (9) but by turning of ring such as that effective as the first reflector mount (23) and/or the outer bearing ring (27). The shell (9) may remain stationary to the bearing member (22).

The desired effect of the present invention is the changing of the aperture (21) size, defined between an racially extending edge of each of the reflectors (i.e. by the changing of relative angular position of the two reflectors to each other) by a rotation of the shell (9) in one direction, and the position of the aperture relative the mount (10) to change the direction of cast light without changing aperture size (ie by maintaining of the relative angle between the reflectors) when rotated in the other direction.

The table below sets out examples of a number of ways of achieving the same effect of the invention:

| | Angle (Co Rotate) | | Aperture (Counter Rotate) | |
|---|---|---|---|---|
| 1. | Friction | $1^{st}$ one way means to engage and rotate both reflectors<br>will overcome $2^{nd}$ one way means | Friction | $2^{nd}$ one way to engage stationary any point and rotate one reflector relative to other<br>will overcome $1^{st}$ one way means |
| 2. | Friction | $1^{st}$ one way to engage and rotate both reflectors<br>will overcome $2^{nd}$ one way means | Gears | Between $1^{st}$ and $2^{nd}$ reflectors (synchronous or asynchronous) to rotate one reflector relative to another<br>with $2^{nd}$ one way to allow Co-rotation<br>will rotate opposite to first one way |
| 3. | Gears | synchronous to engage and rotate<br>engage $1^{st}$ and $2^{nd}$ reflectors<br>will overcome $2^{nd}$ one way<br>with $1^{st}$ one way to allow counter-rotation | Friction | with $2^{nd}$ one way to engage a stationary point and hold reflector stationary<br>will overcome $1^{st}$ one way |
| 4. | Gears | synchronous to give rotation of $1^{st}$ and $2^{nd}$ reflectors<br>with $1^{st}$ one way to allow counter-rotation<br>will overcome $2^{nd}$ one way | Gears | asynchronous/ synchronous to give relative rotation of $1^{st}$ and $2^{nd}$ reflectors<br>with $2^{nd}$ one way to allow co-rotation<br>will overcome $1^{st}$ one way |

The system may alternatively supply a source of utility (for example air conditioned air or water) provided interior to the first and second blanking members. The amount delivered can be controlled by varying the relative angle of the first and second members, and the direction can be controlled by varying the direction of the resulting aperture. A closer fitting of the first and second members would be required to give the requisite sealing.

In yet further embodiments the rotation mechanism (38) or part thereof, rather than being driven by the enclosure (9) or similar may be driven by a motor or motors. For example a worm drive on one of more of the planetary gears or sun ring gears.

The foregoing description of the invention includes preferred forms thereof. Modifications may be made thereto without departing from the scope of the invention.

The invention claimed is:

1. A lamp comprising, a bearing member, a first reflector and a second reflector mounted for rotation dependent from said bearing member in a concentric relationship but at non-coincident radii to each other about an axis, said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, the opening of said first reflector positionable to be, at least in part, contiguous the opening of said second reflector to thereby define an aperture for light from said light source to project radially out from said lamp, a rotation limiter operative between said first reflector and said second reflector that (a) in said first direction of rotation of said first reflector prevents relative rotation between said first reflector and said second reflector to allow said first and second reflectors to be rotated at the same rotational velocity about said axis to thereby change the rotational orientation of said aperture, and (b) in said second direction of rotation of said first reflector does not prevent relative rotation between said first reflector and second reflector to allow said first and said second reflector to move relative each other at different rotational velocities about said axis to thereby change said aperture size.

2. A lamp as claimed in claim 1 wherein said rotation limiter is a ratchet that includes a series of ratchet teeth carried by one of said first and second reflectors and presented coaxially said axis, and at least one ratchet pawl carried by the other of said first and second reflectors, said pawl engaged with said series of teeth to i) move thereover in said second direction of rotation of said first reflector, and ii) to lock with said series teeth in said first direction of movement of said second reflector.

3. A lamp as claimed in claim 1 wherein said second reflector is journalled to said bearing member in a manner so that a resistance to relative rotation between said bearing member and said second reflector is established.

4. A lamp as claimed in claim 3 wherein said resistance is as a result of friction.

5. A lamp as claimed in claim 3 wherein said resistance is sufficient to overcome the result of any resistance to rotation between said first and second reflectors resultant from said rotation limiter when said first reflector is rotated in the second direction, thereby allowing said relative rotation between said first and second reflectors and wherein said second reflector remains stationary relative to said bearing member.

6. A lamp comprising or including, a first aperture defining member able to be driven to rotate about a rotational axis, an input cog able to be driven about a second rotational axis parallel to the first mentioned rotational axis, an output cog mounted co-axially to said input cog in one way drivable engagement, whether directly or indirectly, with said input cog, a first ring member able to be driven by said output cog to rotate a second aperture defining member about said first mentioned rotational axis, said first and second aperture defining members able to define at least one aperture to an at least partial enclosure that can be defined between the first and second aperture defining members and within which a light source can be placed, wherein driving said input cog in a first direction about the second rotational axis rotates the first and second aperture defining members relative each other to alter the size of the at least one aperture there between, and driving said input cog in a second opposite direction about the second rotational axis rotates the first and second aperture defining members about the axis to alter the angular location of said at least one aperture about said axis without changing the size of the at least one aperture there between.

7. A lamp as claimed in claim 6 wherein said first aperture defining member is mounted to move along an arc of radius concentric to, and outward from, an arc along which said second aperture defining member is mounted to move.

8. A lamp as claimed in claim 6 wherein said first aperture defining member is mounted to move along an arc of radius concentric to, and inward from, an arc along which said second aperture defining member is mounted to move.

9. A lamp as claimed in claim 6 wherein said first aperture defining member is able to be rotationally driven by a second ring member that is rotationally mounted about the first mentioned rotational axis.

10. A lamp as claimed in claim 6 wherein said input cog, when rotated in one rotational direction wherein it is in said one way drivable engagement by said output cog, drives said output cog to rotate said second aperture defining member at a different rotational velocity than said first aperture defining member to vary the relative positions of the apertures of the first and second aperture defining members to thereby change the effective aperture size for light cast from said light source, and when rotated in an opposite direction to said one rotational direction wherein it is not in said one way drivable engagement by said output cog, leaves said output cog idle to not rotate said second aperture defining member.

11. A light housing adapted to retain a light source, comprising mounted for rotation concentrically about a main axis is a first reflector, and a second reflector, but at non-coincident radii to each other about the main axis, the first reflector rotatable, by actuation, in a first direction of rotation and a second direction of rotation opposite to the first direction of rotation about the main axis, wherein rotation of said first reflector in a first direction about said main axis rotates the second reflector at the same angular velocity about the main axis to retain the same relative angular position between the first and second reflector, and rotation of said first reflector in a second direction of rotation, opposite to the first direction, rotates second reflector to vary the relative angular position between the first and second reflector to thereby change an aperture size.

12. A light housing as claimed in claim 11 wherein said first reflector is rotatable by a rotation actuator that can be controlled for rotation by a person.

13. A light housing as claimed in claim 12 wherein said rotation actuator is ring rotationally mounted to rotate about said main axis.

14. A light housing as claimed in claim 12 wherein said rotation actuator is a shell about both said first and second reflectors that is rotationally mounted to rotate about said main axis.

15. A light housing as claimed in claim 11 wherein said first reflector is journalled to said second reflector.

16. A light housing as claimed in claim 15 wherein the journalled relationship between said first and second reflector has a sufficient frictional interface to cause the rotation of said second reflector with said first reflector when it is rotated in the first direction about the main axis.

17. A light housing as claimed in claims 11 wherein upon rotation of said first reflector in a second direction of rotation, opposite to the first direction, rotation of second reflector at a different rotational velocity about said main axis is effected.

18. A light housing as claimed in claim 17 wherein the rotation of said second reflector is effected by a transmission that is operatively interposed between the first and second reflectors, said transmission including an automatic clutch mechanism that engages the transmission for transfer of torque from said first reflector to said second reflector in the second direction of rotation and disengages the transmission in the first direction of rotation.

19. A lamp comprising, a bearing member, a first reflector and a second reflector mounted for rotation dependent from said bearing member in a concentric relationship but at non-coincident radii to each other about an axis, said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, said opening of said first reflector positionable to be, at least in part, contiguous said opening of said second reflector to thereby define an aperture for light from said light source to project radially out from said lamp, a rotation transmission that can assume i) an operative condition to, upon the rotation of said first reflector in said second direction of rotation, rotate said first and second reflectors relative each other at different rotational velocities about said axis to thereby change said aperture size, and ii) an inoperative condition to, upon the rotation of said first reflector in said first direction of rotation, allow rotation of said first reflector and said second at the same rotational velocity about said axis to thereby change the rotational orientation of said aperture about said axis.

20. A lamp comprising, a bearing member, a first reflector and a second reflector mounted for rotation dependent from said bearing member in a concentric relationship but at non-coincident radii to each other about an axis, said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, said opening of said first reflector positionable to be, at least in part, contiguous said opening of said second reflector to thereby define an aperture for light from said light source to project radially out from said lamp, a rotation transmission that can assume iii) an inoperative condition to, upon the rotation of said first reflector in said second direction of rotation, allow rotation of said first and second reflectors relative each other at different rotational velocities about said axis to thereby change said aperture size, and iv) an operative condition to, upon the rotation of said first reflector in said first direction of rotation, rotate said first reflector and said second at the same rotational velocity about said axis to thereby change the rotational orientation of said aperture about said axis.

21. A lamp comprising, a bearing member, a first reflector and a second reflector mounted for rotation dependent from said bearing member in a concentric relationship but at non-coincident radii to each other about an axis, said first reflector rotatable, by actuation, in a first direction of rotation and a second direction of rotation opposite to said first direction of rotation about said axis, a light source mounting to mount a light source inward of said radii, to allow said first and second reflectors to rotate at least in part about said light source, said first reflector and second reflector each including an opening to allow radially projecting light from said light source to pass through, said opening of said first reflector positionable to be, at least in part, contiguous said opening of said second reflector to thereby define an aperture for light from said light source to project radially out from said lamp, a rotation transmission that can assume v) a first operative condition to, upon the rotation of said first reflector in said second direction of rotation, allow rotation of said first and second reflectors relative to each other at different rotational velocities, about said axis to thereby change said aperture size, and vi) a second operative condition to, upon the rotation of said first reflector in said first direction of rotation, rotate said first reflector and said second at the same rotational velocity about said axis to thereby change the rotational orientation of said aperture about said axis.

* * * * *